US010656547B2

(12) United States Patent
Kawasaki et al.

(10) Patent No.: US 10,656,547 B2
(45) Date of Patent: May 19, 2020

(54) IMAGE FORMING APPARATUS MOUNTABLE WITH IMAGE BEARING MEMBER UNIT AND DEVELOPER BEARING MEMBER

(71) Applicant: CANON KABUSHIKI KAISHA, Tokyo (JP)

(72) Inventors: Shuhei Kawasaki, Susono (JP); Kodai Hayashi, Suntou-gun (JP); Shinichi Agata, Suntou-gun (JP); Keisuke Endoh, Fuji (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/253,375

(22) Filed: Jan. 22, 2019

(65) Prior Publication Data

US 2019/0227454 A1 Jul. 25, 2019

(30) Foreign Application Priority Data

Jan. 24, 2018 (JP) ..... 2018-010104
Dec. 27, 2018 (JP) ..... 2018-245218

(51) Int. Cl.
*G03G 15/02* (2006.01)
*G03G 15/00* (2006.01)

(52) U.S. Cl.
CPC ..... *G03G 15/0266* (2013.01); *G03G 15/5033* (2013.01); *G03G 15/553* (2013.01)

(58) Field of Classification Search
CPC ..... G03G 15/0266; G03G 15/5033; G03G 15/553; G03G 15/556; G03G 15/0863
See application file for complete search history.

(56) References Cited

U.S. PATENT DOCUMENTS

2014/0016953 A1 1/2014 Yoshida et al.
2016/0349658 A1* 12/2016 Izumi ..... G03G 15/0266
2017/0090331 A1* 3/2017 Kawaguchi ..... G03G 15/0266

FOREIGN PATENT DOCUMENTS

JP H09190140 A 7/1997
JP 2000047459 A 2/2000
(Continued)

OTHER PUBLICATIONS

Extended European Search Report issued in European Appln. No. 19150301.0 dated Jul. 23, 2019.

*Primary Examiner* — Sandra Brase
(74) *Attorney, Agent, or Firm* — Rossi, Kimms & McDowell LLP

(57) ABSTRACT

Provided is an image forming apparatus, including an apparatus main body, an image bearing member unit having at least an image bearing member and a charging member, and a developing unit having at least a developer bearing member. The apparatus main body has a controller, the image bearing member unit further has a first storage unit that stores first correction information corresponding to life information of the developing unit, the developing unit further has a second storage unit that stores second correction information corresponding to life information of the developing unit, and the controller acquires the first correction information and the second correction information, uses the acquired first correction information and the acquired second correction information to correct a charging bias to be applied to the charging member, and applies the corrected charging bias to the charging member.

18 Claims, 13 Drawing Sheets

(56) References Cited

FOREIGN PATENT DOCUMENTS

| | | | |
|---|---|---|---|
| JP | 2001117425 | A | 4/2001 |
| JP | 2009047948 | A | 3/2009 |

* cited by examiner

IMAGE FORMING APPARATUS MOUNTABLE WITH IMAGE BEARING MEMBER UNIT AND DEVELOPER BEARING MEMBER

BACKGROUND OF THE INVENTION

Field of the Invention

The present invention relates to an electrophotographic system image forming apparatus in which an attachable/detachable process cartridge adopts a two-body configuration of an image bearing member unit and a developing unit. Examples of an image forming apparatus include a copier, a printer (such as a laser beam printer or an LED printer), a facsimile device, a word processor, or a multifunctional machine (a multifunctional printer) that combines these devices.

Description of the Related Art

In electrophotographic system image forming apparatuses, a system is known in which a toner storage portion, developing means, a photosensitive member, charging means, cleaning means including a waste toner container, and the like are integrated as a process cartridge and configured to be attachable to and detachable from the image forming apparatus for the purpose of simplifying replacement and maintenance of expendable items such as the photosensitive member and toner. In addition, a mode in which a process cartridge is mounted with storage unit (a memory) to manage cartridge information is also known.

For example, Japanese Patent Application Laid-open No. 2001-117425 (Patent Literature 1) discloses a technique which causes, in an image forming apparatus described therein, storage unit provided in process cartridges to store information related to parameter values for changing conditions specific to each process cartridge as information for changing image forming process conditions.

In addition, in an image forming apparatus described in Japanese Patent Application Laid-open No. H09-190140 (Patent Literature 2), a process cartridge is mounted with a nonvolatile storage unit capable of reading/writing to/from an apparatus main body for the purpose of attaining potential stability of a photosensitive drum (an image bearing member). Patent Literature 2 discloses control which causes the storage unit to store information such as charging characteristics, a mechanical characteristic value, and a type of a charging member and which charges the photosensitive drum by switching among conditions of a charging bias to be applied to the charging member in accordance with the information.

Furthermore, Japanese Patent Application Laid-open No. 2000-47459 (Patent Literature 3) discloses an image forming apparatus provided with a storage unit which stores characteristics of a photosensitive drum and control means which performs control so as to correct conditions of a charger, an optical unit, a developing unit, or a transfer roller in accordance with the characteristics of the photosensitive drum.

SUMMARY OF THE INVENTION

With the recent diversification of user needs, modes of image forming apparatuses using an electrophotographic image forming process include a two-body mode which adopt two separate process cartridges featuring mutually different functions. For example, there is a mode in which a photosensitive unit (an image bearing member unit) at least having a photosensitive drum (an image bearing member) and a developing unit which integrates developing means with a toner container for storing toner to be used are respectively made attachable to and detachable from an apparatus main body. Compared to a conventional process cartridge which integrates a photosensitive unit and a developing unit, each unit of such a two-body configuration has an advantage in that, for example, when the units each have a different life, each unit can be used for the duration of its individual replacement life.

In an image forming apparatus with a two-body configuration having such an advantage, the following problem needs to be addressed in order to maintain potential stability of a photosensitive drum over a long period of time.

Generally, production of expendable items such as a photosensitive unit and a developing unit continues even after the end of production of the image forming apparatus. Accordingly, when specifications of a photosensitive drum, a charging roller, or the like are changed due to procurement statuses of materials, there may be cases where control information for performing appropriate charge control also changes. Examples of such cases include a change to a film thickness of the photosensitive drum to be used and a change to an abrasion rate of the photosensitive drum due to a change in hardness of the photosensitive drum.

However, when a photosensitive unit and a developing unit are provided as separate process cartridges, and photosensitive units and developing units are distributed to the market, a combination of the units depends on which units a user purchases and mounts to an image forming apparatus. As described above, specifications of a photosensitive drum or a charging roller are subject to change due to various factors and, unless a combination of units can be predicted, an image forming apparatus can no longer execute appropriate control.

It is provided with a view to achieving one aspect as describe above an image forming apparatus, including:

an apparatus main body;

an image bearing member unit having at least an image bearing member and a charging member; and a developing unit having at least a developer bearing member, wherein the image bearing member unit and a developing unit are independently attachable and detachable to the apparatus main body, the apparatus main body has a controller, the image bearing member unit further has a first storage unit that stores first correction information corresponding to life information of the developing unit, the developing unit further has a second storage unit that stores second correction information corresponding to life information of the developing unit, and the controller acquires the first correction information stored in the first storage unit and the second correction information stored in the second storage unit, uses the acquired first correction information and the acquired second correction information to correct a charging bias to be applied to the charging member, and controls to apply the corrected charging bias to the charging member.

Further features of the present invention will become apparent from the following description of exemplary embodiments with reference to the attached drawings.

DESCRIPTION OF THE EMBODIMENTS

Hereinafter, the present invention will be described in detail based on illustrated embodiments.

An image forming apparatus refers to an apparatus which, for example, forms an image on a recording medium using an electrophotographic image forming process. Examples of image forming apparatuses include an electrophotographic copier, an electrophotographic printer (such as an LED printer or a laser beam printer), and an electrophotographic facsimile device.

In addition, cartridges refer to those which are attachable to and detachable from an image forming apparatus main body. Among such cartridges, a cartridge which integrates a photosensitive drum or process means that acts on a photosensitive drum will be specifically referred to as a drum cartridge (a drum unit). In addition, a cartridge which integrates process means associated with development will be referred to as a developing cartridge (a developing unit).

Furthermore, a full-color image forming apparatus to/from which four sets of drum cartridges and developing cartridges are attachable/detachable is exemplified in the following embodiments. However, the numbers of drum cartridges and developing cartridges to be mounted to an image forming apparatus are not limited thereto. In a similar manner, in the respective configurations disclosed in the embodiments, materials, arrangements, dimensions, other numerical values, and the like are not limited to those described unless otherwise specifically noted to the contrary. In addition, above refers to upward in a direction of gravitational force when installing the image forming apparatus unless otherwise expressly provided.

Figure 1:
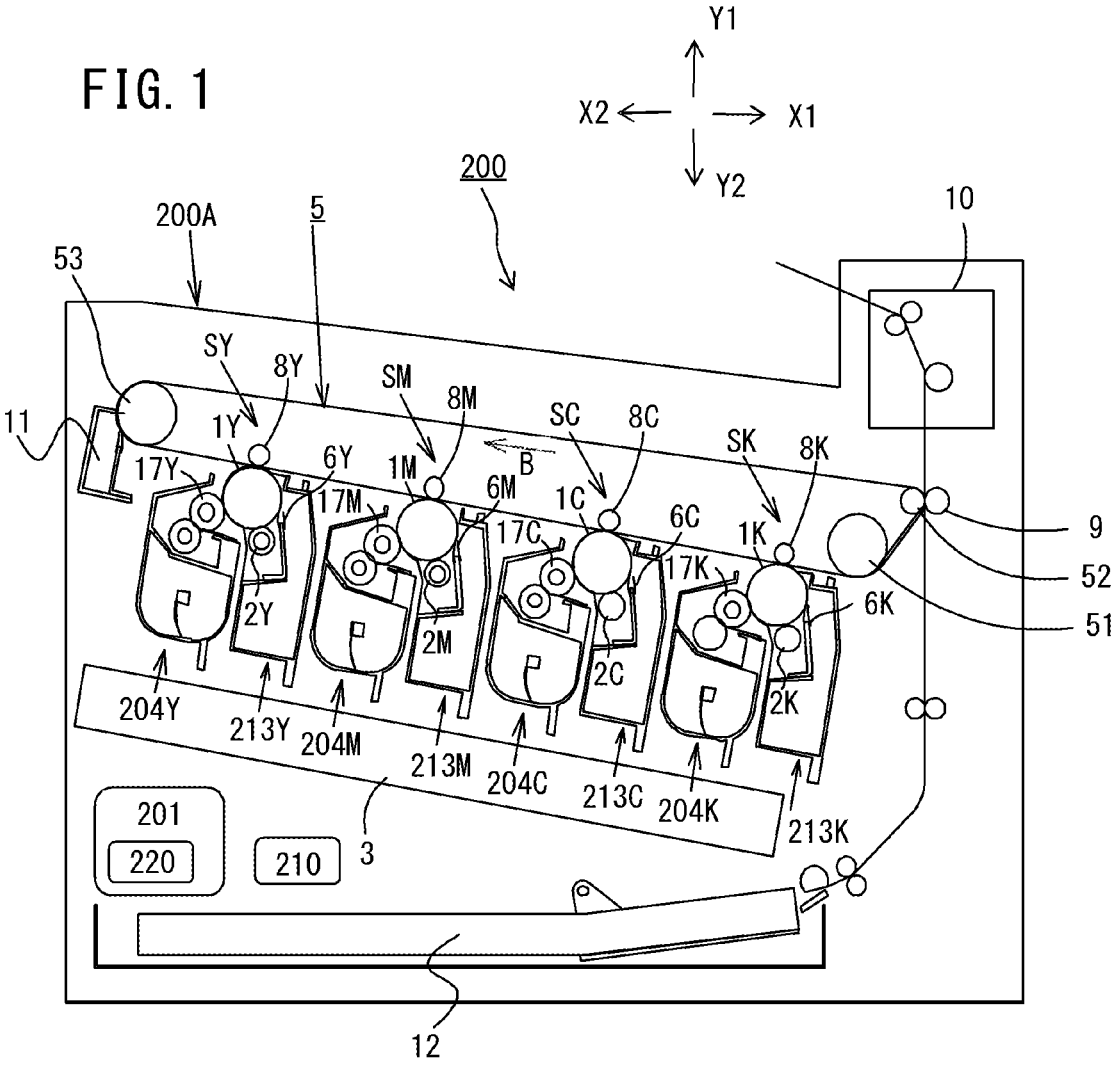
FIG. 1 is a schematic sectional view of an image forming apparatus to which the present invention is applied.

First, an overall configuration of an electrophotographic system image forming apparatus to which the present invention is applied will be described. FIG. 1 is a schematic sectional view of an image forming apparatus 200. As shown in FIG. 1, as a plurality of image forming portions, the image forming apparatus 200 includes first, second, third, and fourth image forming portions SY, SM, SC, and SK for respectively forming images of the colors yellow (Y), magenta (M), cyan (C), and black (K). In the present embodiment, the first to fourth image forming portions SY, SM, SC, and SK are arranged in a single row in an approximately horizontal direction. The respective image forming portions SY, SM, SC, and SK are provided with drum cartridges 213 (213Y, 213M, 213C, and 213K) and developing cartridges 204 (204Y, 204M, 204C, and 204K). In the present embodiment, configurations and operations of the drum cartridges 213 (213Y, 213M, 213C, and 213K) and the developing cartridges 204 (204Y, 204M, 204C, and 204K) are substantially the same with the exception of differences in colors of images formed. Therefore, unless a specific distinction needs to be made, Y, M, C, and K will be omitted and the image forming portions and the cartridges will be collectively described.

The drum cartridge 213 and the developing cartridge 204 of each of the image forming portions SY, SM, SC, and SK are provided side by side in a direction slightly inclined with respect to the horizontal direction, and a scanner unit (an exposing apparatus) 3 is arranged below the drum cartridge 213 and the developing cartridge 204 in a direction of gravitational force.

The developing cartridge 204 and the drum cartridge 213 are guided by a guide such as a mounting guide or a positioning member (not shown) provided on a main body frame body of an image forming apparatus main body 200A and are respectively configured so as to be independently attachable to and detachable from the image forming apparatus main body 200A. Toner of each of the colors yellow (Y), magenta (M), cyan (C), and black (K) is stored inside the developing cartridge 204 which corresponds to the color.

A charging roller 2 as a charging member as process means that acts on a photosensitive layer of a photosensitive drum 1 of the drum cartridge 213, a cleaning blade 6 as cleaning means (a cleaning apparatus or a cleaning member), and a developing roller 17 of the developing cartridge 204 are arranged around the photosensitive drum 1.

The charging roller 2 is charging means (a charging apparatus or a charging member) which uniformly charges a surface of the photosensitive drum 1, and the scanner unit (an exposing apparatus) 3 is exposing means (an exposing apparatus or an exposing member) which irradiates a laser based on image information and forms an electrostatic image (an electrostatic latent image) on the photosensitive drum 1.

A charging bias voltage is applied to the charging roller 2 from a charging bias voltage supply (not illustrated) and the photosensitive drum 1 is charged to a prescribed charging potential (in the present embodiment, −500 V). A charging bias determination process will be described later. While a direct-current voltage (DC) is used as the charging bias in the present embodiment, the charging bias is not limited thereto and a so-called AC+DC superimposed voltage obtained by superimposing an AC voltage on a DC voltage may be used instead.

In addition, using a developer, the developing roller 17 of the developing cartridge 204 develops the electrostatic latent image formed on the photosensitive drum 1 by the scanner unit 3. In the present embodiment, a non-magnetic single component toner (hereinafter, a toner) is used as the developer and a contact developing system is adopted in which the developing roller 17 as a developer bearing member is brought into contact with the photosensitive drum 1.

Furthermore, an intermediate transfer belt 5 as an intermediate transfer member for transferring a toner image on the photosensitive drum 1 is arranged so as to oppose the four photosensitive drums 1 of the drum cartridges 213 of the respective image forming portions SY, SM, SC, and SK.

The intermediate transfer belt 5 comes into contact with the photosensitive drum 1 provided in each drum cartridge 213 and rotates (moves) in a direction of an arrow B in FIG. 1. The intermediate transfer belt 5 is stretched over a plurality of supporting members (a driver roller 51, a secondary transfer opposing roller 52, and a driven roller 53). Four primary transfer rollers 8 as primary transfer means are arranged parallel to each other on a side of an inner peripheral surface of the intermediate transfer belt 5 so as to oppose each photosensitive drum 1. In addition, a secondary transfer roller 9 as secondary transfer means is arranged at a position opposing the secondary transfer opposing roller 52 on a side of an outer peripheral surface of the intermediate transfer belt 5.

Next, an image forming method will be described.

First, by applying a bias to the charging roller 2 from a charging bias power supply (not illustrated) inside the image forming apparatus main body, the surface of the photosensitive drum 1 is uniformly charged. Next, due to laser light in accordance with image information transmitted from the scanner unit 3, the charged surface of the photosensitive drum 1 is subjected to scanning exposure. Accordingly, an electrostatic latent image corresponding to the image information is formed on the photosensitive drum 1. The electrostatic latent image formed on the photosensitive drum 1 is developed by the developing cartridge 204 as a toner image. The toner image formed on the photosensitive drum 1 is transferred (primarily transferred) onto the intermediate transfer belt 5 by an action of the primary transfer roller 8.

For example, when forming a full-color image, the process described above is sequentially performed by the four drum cartridges 213 (213Y, 213M, 213C, and 213K) and the four developing cartridges 204 (204Y, 204M, 204C, and 204K). In addition, toner images in the respective colors formed on the photosensitive drum 1 of the respective drum cartridges 213 are sequentially primarily transferred onto the intermediate transfer belt 5 so as to overlap with each other. Subsequently, a recording material 12 is transported to a secondary transfer portion in synchronization with a movement of the intermediate transfer belt 5. In addition, the four-color toner image on the intermediate transfer belt 5 is collectively transferred onto the recording material 12 having been transported to the secondary transfer portion formed by the intermediate transfer belt 5 and the secondary transfer roller 9.

The recording material 12 onto which the toner image has been transferred is conveyed to a fixing apparatus 10 as fixing means. At the fixing apparatus 10, heat and pressure are applied to the recording material 12 to fix the toner image onto the recording material 12. In addition, primary transfer residual toner that remains on the photosensitive drum 1 after the primary transfer process is removed by the cleaning blade 6 and recovered as waste toner. Furthermore, secondary transfer residual toner that remains on the intermediate transfer belt 5 after the secondary transfer process is removed by a cleaning apparatus 11 of the intermediate transfer belt 5. Moreover, the image forming apparatus 200 is also configured to form a single-color or multi-color image using a single or some (not all) desired image forming portions.

In addition, an environmental sensor 210 as means for measuring temperature and humidity as an environment inside the main body is arranged in the image forming apparatus 200, and a control unit 220 which calculates an absolute moisture content as environmental information from temperature and humidity is arranged inside a main body controller 201. The environmental sensor 210 detects current temperature and humidity and obtains an absolute moisture content in air from the temperature (° C.) and the relative humidity (% RH). Under atmospheric pressure of 760 mmHg, the absolute moisture content has values of 21.5 g at 30° C. and 80% RH, 1.1 g at 15° C. and 10% RH, and 11.8 g at 25° C. and 60% RH. While an example in which the environmental sensor 210 is installed inside the image forming apparatus 200 to detect temperature and humidity inside the image forming apparatus 200 will be described in the present embodiment, the environmental sensor 210 may be installed outside the image forming apparatus 200 and charging voltage control may be performed based on temperature and humidity outside the image forming apparatus 200.

Configurations of Drum Cartridge and Developing Cartridge

Next, the drum cartridges 213 (213Y, 213M, 213C, and 213K) and the developing cartridges 204 (204Y, 204M, 204C, and 204K) shown in FIG. 1 will be described with reference to FIGS. 2A and 2B to FIGS. 4A and 4B.

It should be noted that the drum cartridge 213Y, the drum cartridge 213M, the drum cartridge 213C, and the drum cartridge 213K share the same configuration and are usable regardless of color. In addition, the developing cartridge 204Y storing yellow toner, the developing cartridge 204M storing magenta toner, the developing cartridge 204C storing cyan toner, and the developing cartridge 204K storing black toner share the same configuration with the only difference being the toners. Therefore, in the following description, the respective drum cartridges 213Y, 213M, 213C, and 213K will be collectively referred to as the drum cartridge 213 and the respective developing cartridges 204Y, 204M, 204C, and 204K will be collectively referred to as the developing cartridge 204. Each of the cartridge components will also be described using a collective term.

Drum Cartridge

Figure 2A:
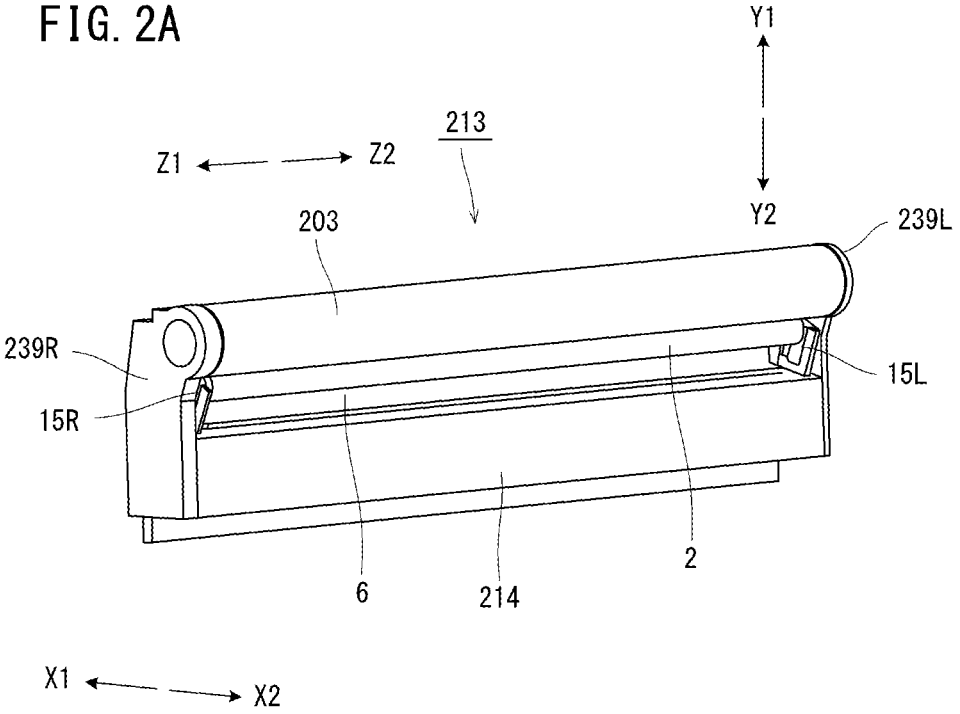
FIG. 2A is an external view of a drum cartridge.

FIG. 2A is an external perspective view of the drum cartridge 213. As shown in FIG. 2A, a rotational axis direction of the photosensitive drum 1 is assumed to be a Z direction (an arrow Z1 and an arrow Z2), a horizontal direction in FIG. 1 is assumed to be an X direction (an arrow X1 and an arrow X2), and a vertical direction in FIG. 1 is assumed to be a Y direction (an arrow Y1 and an arrow Y2).

Drum unit bearing members 239R and 239L are respectively attached to both sides of a cleaning frame body 214 and respectively support a photosensitive drum unit 203. Accordingly, the photosensitive drum unit 203 is rotatably supported by the cleaning frame body 214.

In addition, the charging roller 2 and the cleaning blade 6 are attached to the cleaning frame body 214 and arranged so as to come into contact with the surface of the photosensitive drum 1. Furthermore, charging roller bearings 15L and 15R are attached to the cleaning frame body 114. The charging roller bearings 15L and 15R are bearings for supporting an axis of the charging roller 2.

Figure 2B:
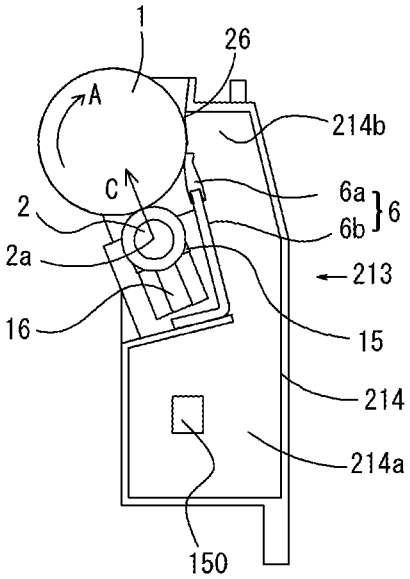
FIG. 2B is a schematic sectional view thereof.

In this case, the charging roller bearings 15L and 15R are attached so as to be movable in a direction of an arrow C shown in FIG. 2B. A rotational axis 2*a* of the charging roller 2 is rotatably attached to the charging roller bearing 15. In addition, the charging roller bearing 15 is biased toward the photosensitive drum 1 by a pressure spring 16 as biasing means. Accordingly, the charging roller 2 comes into contact with the photosensitive drum 1 and is driven to rotate by the photosensitive drum 1.

The cleaning blade 6 as cleaning means for removing toner remaining on the surface of the photosensitive drum 1 is provided on the cleaning frame body 214. The cleaning blade 6 integrates a blade-like rubber (an elastic member) 6*a* which comes into contact with the photosensitive drum 1 and removes toner on the photosensitive drum 1 with a supporting sheet metal 6*b* which supports the blade-like rubber 6*a*. In the present embodiment, the supporting sheet metal 6*b* is fixed and attached to the cleaning frame body 214 by a screw.

As described earlier, the cleaning frame body 214 has an opening 214*b* for recovering untransferred toner recovered by the cleaning blade 6. The recovered untransferred toner is stored in a removed developer storage portion (hereinafter, referred to as a waste toner storage portion) 214*a* through the opening 214*b*. The waste toner storage portion 214*a* and the cleaning blade 6 are integrated and constitute the drum cartridge 213. The opening 214*b* is provided with a blow-out prevention sheet 26 which comes into contact with the photosensitive drum 1 and which provides a seal between the photosensitive drum 1 and the opening 214*b*, and the blow-out prevention sheet 26 prevents upward leakage of toner from the opening 214*b*.

Furthermore, a nonvolatile drum memory 150 for storing expendable item information of the cleaning unit and control information to be used for potential control of the photosensitive drum is arranged on the cleaning frame body 214, and the nonvolatile drum memory 150 is capable of communicating with the control unit 220 of the image forming apparatus to be described later.

In addition, film thickness information of the drum cartridge 213 which is life information of the photosensitive drum 1 is calculated by the control unit 220 of the image forming apparatus main body based on a rotation time of the photosensitive drum 1 and use environmental information of the main body and sequentially updated and held in the drum memory 150. A replacement life ends when a life film thickness held in the drum memory 150 is reached. Life control of units and correction control of a charging bias (to be described later) are performed based on the film thickness information.

The life information of the photosensitive drum 1 is not limited to film thickness information and may be a cumulative number of revolutions or a cumulative rotating time of the photosensitive drum or indirect information such as a cumulative number of printed surfaces, a cumulative number of printed pages, or an energization time of a motor that drives the photosensitive drum. In addition, life information also includes parameters based on a remaining number of possible revolutions or a remaining rotation time which decreases with use of the photosensitive drum instead of the number of revolutions and the like having elapsed from the start of use.

Figure 3:
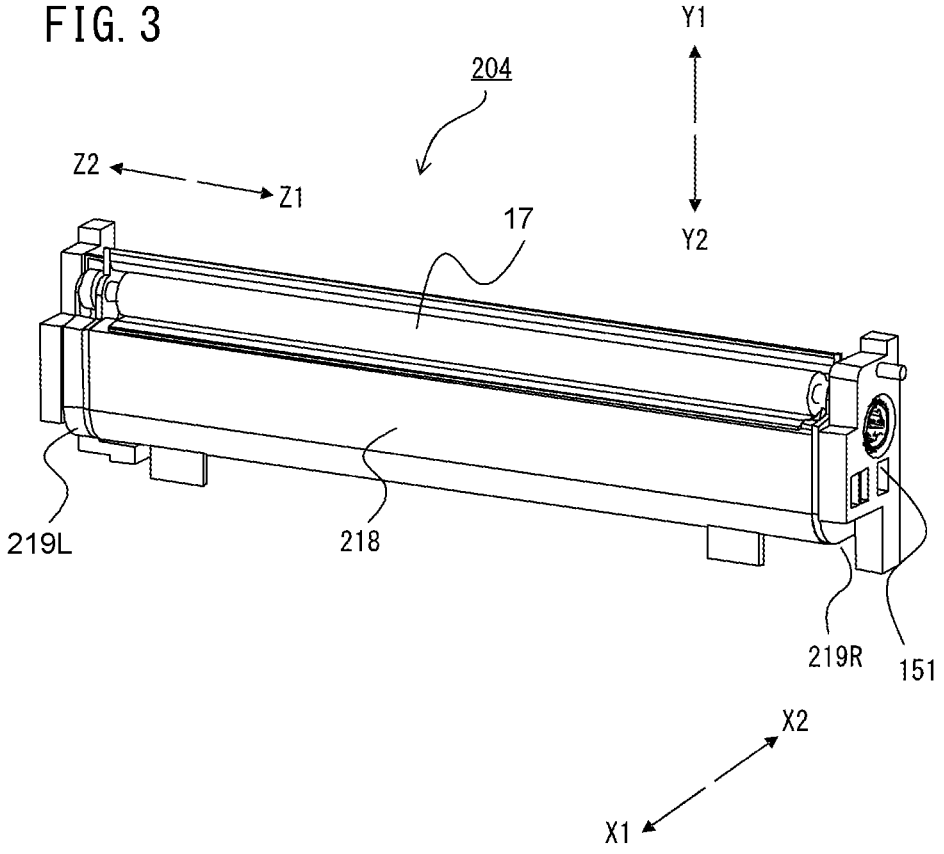
FIG. 3 is a schematic view of a developing cartridge.

FIG. 3 is an external perspective view of the developing cartridge 204.

The developing cartridge 204 has a developing frame body 218 which supports various elements. The developing cartridge 204 is provided with a developing roller 17 as a developer bearing member which comes into contact with the photosensitive drum 1 and which rotates in a direction of an arrow D (a counterclockwise direction) in FIG. 4A. The developing roller 17 is rotatably supported at both ends in a longitudinal direction thereof (a direction of a rotational axis thereof) by the developing frame body 218 via developing bearings 219R and 219. The developing bearings 219R and 219L are respectively attached to both sides of the developing frame body 218.

Figure 4A:
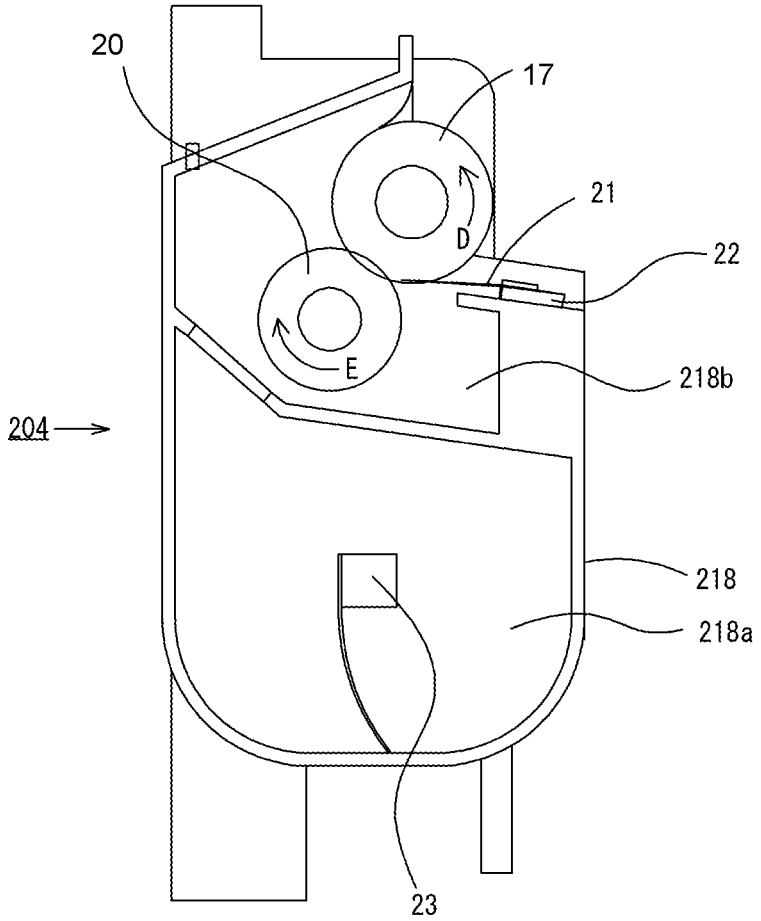
FIG. 4A is a sectional view of a developing cartridge.

In addition, as shown in FIG. 4A, the developing cartridge 204 has a developer storage chamber (hereinafter, a toner storage chamber) 218*a* and a developing chamber 218*b* in which the developing roller 17 is arranged.

A toner supplying roller 20 as a developer supplying member which comes into contact with the developing roller 17 and which rotates in a direction of an arrow E and a developing blade 21 as a developer regulating member for regulating a toner layer (a developer layer) of the developing roller 17 are arranged in the developing chamber 218*b*. The developing blade 21 is fixed to and integrated with a fixing member 22 by welding or the like.

Furthermore, a stirring member 23 for stirring stored toner and conveying the toner to the toner supplying roller 20 is provided in the toner storage chamber 218*a* of the developing frame body 218.

In addition, a nonvolatile developing memory 151 as first storing means for storing expendable item information of the developing cartridge and control information for image optimization is arranged in the toner storage chamber 218*a* of the developing frame body 218, and the developing memory 151 is capable of communicating with the control unit 220 of the image forming apparatus.

Furthermore, life information (hereinafter, a developing life) of the developing cartridge 204 is calculated by the control unit 220 of the image forming apparatus main body based on a rotation time of the developing roller 17 and sequentially updated and stored in the developing memory 151. A replacement life ends when the number of revolutions held in the developing memory 151 is reached. Correction control of a charging bias (to be described later) is performed based on the developing life information.

The life information of the developing cartridge 204 may be a cumulative number of revolutions or a cumulative rotating time of the developing roller 17 or indirect information such as a cumulative number of printed surfaces, a cumulative number of printed pages, or an energization time of a motor that drives the developing roller 17. In addition, life information also includes parameters based on a remaining number of possible revolutions or a remaining rotation time which decreases with use of the photosensitive drum instead of the number of revolutions and the like having elapsed from the start of use.

Control Block Diagram

A control block diagram of the image forming apparatus 200 will now be described.

The main body controller 201 has the control unit 220 (a central processing unit) as control means that is a core element for performing arithmetic processing, a main body memory 221 which is storing means such as a ROM and a RAM, an input/output interface 222 which performs input and output of information to and from peripheral devices, and the like. The RAM of the main body memory 221 stores a detection result, a calculation result, and the like of the environmental sensor 210, and the ROM of the main body memory 221 stores a control program, data tables obtained in advance such as an applied charge table storage portion (to be described later), and the like. The control unit 220 is control means that comprehensively controls operations of the image forming apparatus 200, and each control object in the image forming apparatus 200 is connected to the control unit 220 via the input/output IF 222. In addition, the control unit 220 controls transmission and reception of various electrical information signals, drive timings, and the like and manages processing of the flow charts to be described later.

A motor drive member 511 refers to various motors which are power sources for rotationally driving a polygon scanner, the photosensitive drum 1, the developing roller 17, and the like and operates based on a control signal from the control unit 220. A high-voltage power supply 512 is a power supply that applies high voltage to the photosensitive drum 1, the charging roller 2, the developing roller 17, the primary transfer roller 8, the secondary transfer roller 9, the fixing apparatus 10, and the like.

In addition, the drum memory 150 of the drum cartridge 213 and the developing memory 151 of the developing cartridge 204 are connected to the main body controller 201 via a memory communication portion 500.

First Embodiment

Correction control of a charging bias of the image forming apparatus according to a first embodiment of the present invention will be described below.

Two main factors that hinder stability of a charging potential of the photosensitive drum 1 are a potential change due to staining of the charging roller 2 and a potential change due to wear of the photosensitive drum 1 caused by discharge. These factors are known to be susceptible to being influenced by surface characteristics of the used charging roller 2, hardness of the used photosensitive drum 1, durability deterioration of the used developing toner, and the like. The factors are also strongly influenced by temperature and humidity of the environment in which the image forming apparatus is used.

In the present first embodiment, correction information of a charging bias to be applied to the charging roller 2 is respectively held in the developing cartridge 204 and the drum cartridge 213. A feature of the present first embodiment is that the developing cartridge 204 holds, with respect to combinations of the drum cartridge 213, information optimized also in consideration of a difference in staining by the developing cartridge 204.

This approach is effective when the number of combinations of the drum cartridge 213 is limited to around two to three. In addition, due to increased accuracy, this approach is also effective when the life of the developing cartridge 204 is shorter than the life of the drum cartridge 213 and the developing cartridge 204 is replaced frequently.

Figure 5:
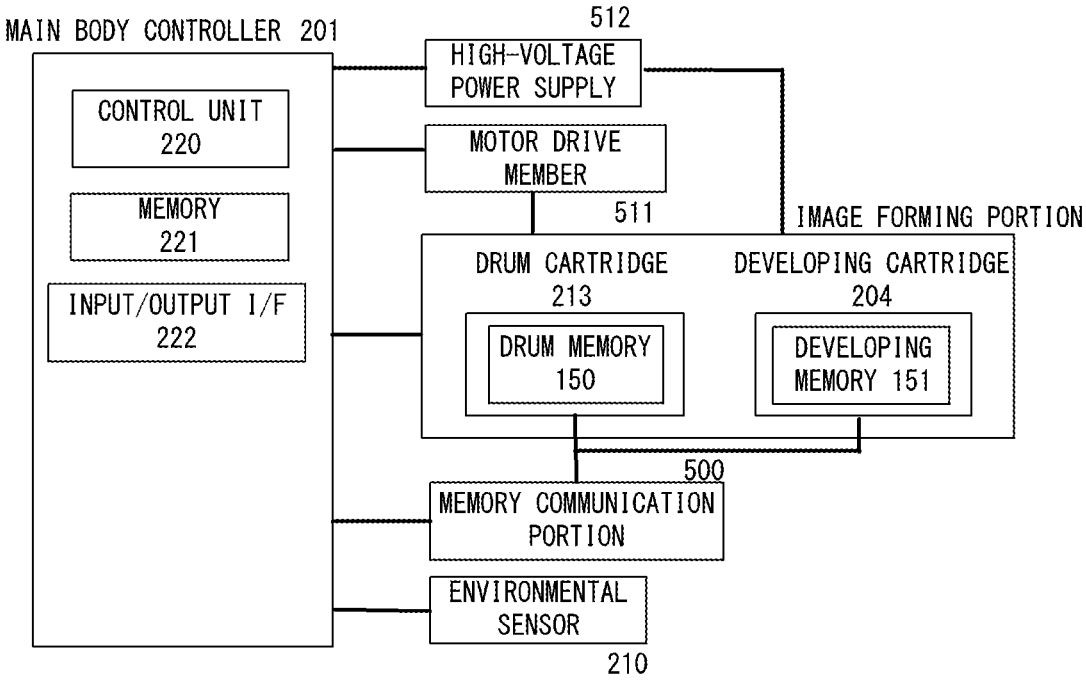
FIG. 5 is a control block diagram of the apparatus shown in FIG. 1.

A description will now be given based on the control block diagram shown in FIG. 5.

The main body memory 221 of an apparatus main body 200A holds, in advance, information of a reference charging bias (reference information) to be applied to the charging roller 2 in accordance with life information of the photosensitive drum 1. The drum memory (the first storage unit) 150 of the drum cartridge (the image bearing member unit) 213 holds, in advance, first correction information in accordance with film thickness information that is life information of the photosensitive drum 1. The developing memory (the second storage unit) 151 of the developing cartridge (the developing unit) 204 holds second correction information in accordance with developing life information that is life information of the developing cartridge 204.

The control unit 220 of the main body controller 201 calculates and sequentially updates film thickness information of the photosensitive drum 1 based on the rotation time and the like of the photosensitive drum 1, and acquires a first correction value (β) corresponding to the film thickness information from first correction information stored in the drum memory 150. The control unit 220 also calculates and sequentially updates a developing life of the developing cartridge 204 based on the rotation time and the like of the developing roller 17, and acquires a second correction value (γ) corresponding to the developing life from second correction information stored in the developing memory 151. In addition, the control unit 220 is configured to correct a reference charging bias (α) based on the acquired first correction value (β) and the second correction value (γ) and adopt the corrected reference charging bias as an applied charging bias to be applied to the charging roller 2. Furthermore, in the first embodiment, a plurality of the reference charging biases and a plurality of pieces of the first correction information and the second correction information are set in accordance with an absolute moisture content that is environmental information.

Correction Control of Charging Bias

Figure 6:
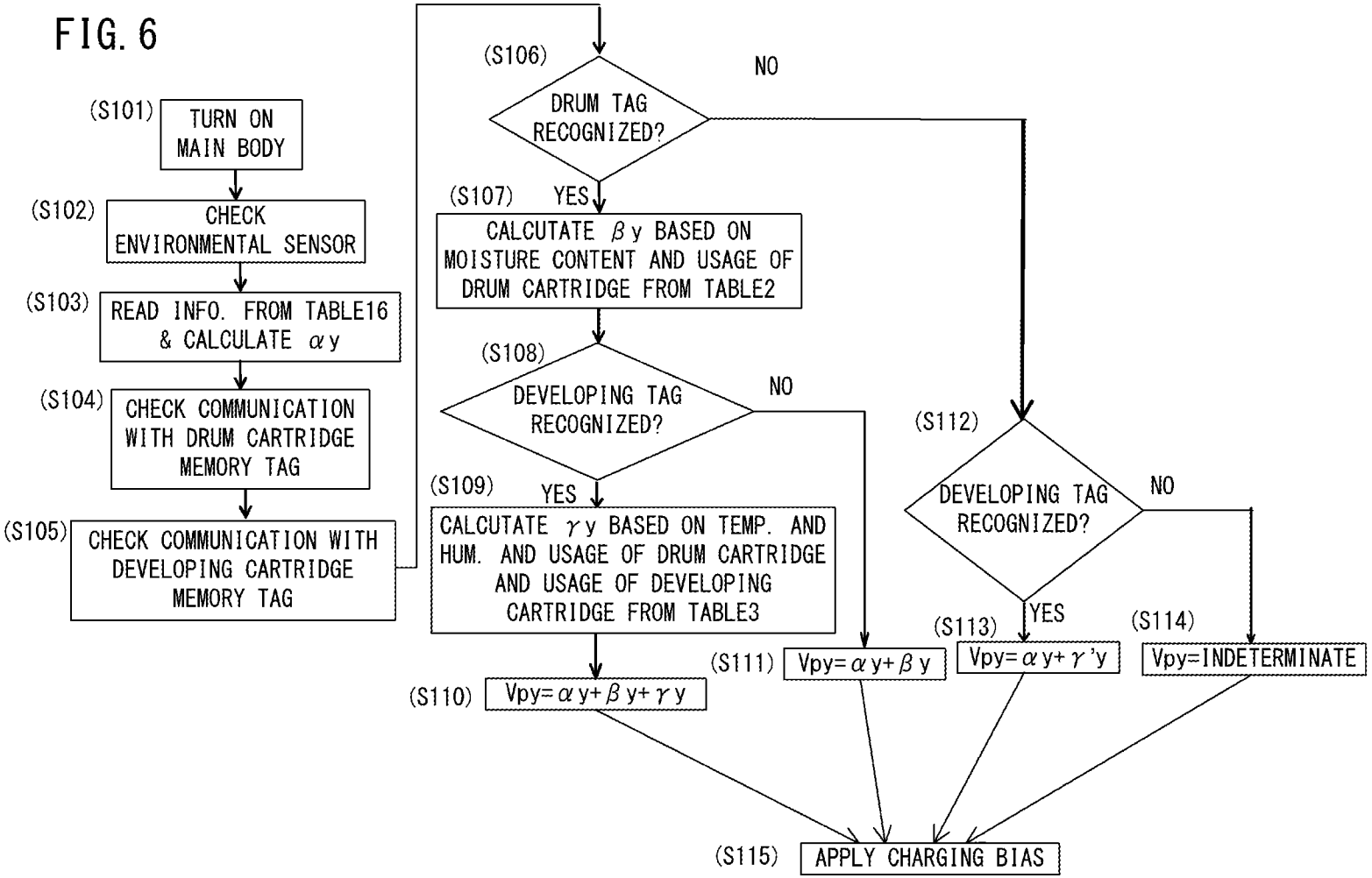
FIG. 6 is a flow chart of correction control according to a first embodiment.

Hereinafter, a flow of correction control of a charging bias according to the present first embodiment will be described in detail according to the flow chart shown in FIG. 6.

In the following description, an operation of 1st (Y station) in the image forming apparatus 200 will be described. Since operations of 2st to 4st are controlled by a similar flow, detailed descriptions thereof will be omitted. In this case, among 1st to 4st, 1st refers to a yellow station, 2st refers to a magenta station, 3st refers to a cyan station, and 4st refers to a black station and will be hereinafter simply described as 1st, 2st, 3st, and 4st.

S101

In S101, the main body power supply of the image forming apparatus 200 is turned on. Accordingly, the control unit 220 starts charging bias control based on the control program stored in the main body memory 221.

S102

In S102, the control unit 220 checks the environmental sensor 210, acquires information on temperature and humidity inside the image forming apparatus 200 as detected by the environmental sensor 210, and calculates an absolute moisture content (hereinafter, referred to as a moisture content) in air as environmental information. Alternatively, when an output value (for example, a resistance value) corresponding to the moisture content in air can be directly acquired from the environmental sensor 210, the calculation of the absolute moisture content may be omitted. The same applies to other tables.

S103

In S103, the control unit 220 reads information (αγ) on a reference charging bias corresponding to the calculated moisture content from a table such as that shown in Table 16. Details of Table 16 will be provided later. It is assumed that Table 16 is stored in advance in the memory 221 of the main body controller 201 and the respective tables to be described later are also stored in advance in any of the memory 221, the drum memory 150, and the developing memory 151.

S104

In S104 the control unit 220 communicates with the drum memory 150 of the drum cartridge 213 and checks the drum memory 150.

S105

In S105, the control unit 220 communicates with the developing memory 151 of the developing cartridge 204 and checks the developing memory 151.

Hereinafter, control differs according to a presence or absence of recognition of the drum memory 150 and the developing memory 151. The presence or absence of recognition may be classified into the following four cases (1A to 1D).

1A: Both the drum memory 150 of the drum cartridge 213 and the developing memory 151 of the developing cartridge 204 are recognized 1B: Only the drum memory 150 of the drum cartridge 213 is recognized (mounted)

1C: Only the developing memory 151 of the developing cartridge 204 is recognized (mounted)

1D: Neither the drum memory 150 of the drum cartridge 213 nor the developing memory 151 of the developing cartridge 204 are recognized (mounted)

In Case of 1A

In this case, the flow proceeds in a sequence of S106. S107 S108, S109, S110, and S115.

When the drum memory is recognized in S106, the flow advances to S107 and a correction value βy in accordance with the absolute moisture content and a use status of the drum cartridge is calculated from Table 2.

In other words, in S107, the control unit 220 acquires film thickness information of the photosensitive drum from the drum memory 150 of the drum cartridge 213. Specifically, film thickness information based on use history information is held in the drum memory 150, and the control unit 220 calculates and sequentially updates film thickness information from the rotation time or the like of the photosensitive drum 1. In addition, the control unit 220 refers to a correction table of Table 2 which is first correction information held in advance in the drum memory 150 and calculates a first correction value (βy) which matches the absolute moisture content calculated in S102 and the acquired drum film thickness of the photosensitive drum 1. Details of Table 2 will be provided later. Furthermore, in S107, since the control unit 220 has already read film thickness information from the drum memory 150, the reference charging bias αy acquired based on the table in Table 16 in S102 is re-acquired based on the table in Table 1. In the present first embodiment, held values of the correction table in Table 2 are all set to 0. In other words, the present first embodiment assumes a case where the influence in variability of assembly during production is small and correction of a charging bias in accordance with specific information of the drum cartridge 213 is not performed.

It should be noted that the drum memory 150 of the drum cartridge 213 does not have color information, and color is determined when the drum cartridge 213 is mounted to the used station. In the present first embodiment, information is stored in the main body controller 201 in advance so that 1st is recognized as yellow, 2st is recognized as magenta, 3st is recognized as cyan, and 4st is recognized as black. In this manner, since the drum cartridge 213 is designed so as to be attachable to and detachable from any station, the drum cartridge 213 can be used in any station. An order of the respective stations and the colors of toners used by the stations are not limited to the above and color information may be freely determined for each station.

S108, S109

Once the correction value βy is calculated, the flow advances to S108 to check a tag of the developing memory and, when the developing memory is present, the flow advances to S109 to calculate a second correction value (γy) from Table 3 in accordance with the temperature and humidity, the use status of the drum cartridge, and the use status of the developing cartridge.

Specifically, the control unit 220 acquires the developing life of the developing cartridge 204 from the developing memory 151 of the developing cartridge 204 and calculates and sequentially updates the developing life from the rotation time or the like of the developing roller 17. In addition, the control unit 220 refers to the correction tables in Table 3 which are held in advance in the developing memory 151 and selects a yellow table from the plurality of correction tables. Furthermore, the control unit 220 calculates the second correction value (γy) matching the moisture content calculated in S102 and the acquired developing life and drum film thickness. Details of Table 3 will be provided later.

S110

In S110, using the reference charging bias αy calculated in S103, the first correction value βy calculated in S107 from Table 2 based on use information of the photosensitive drum 1, and the second correction value γy calculated in S109 based on the use information of the developing cartridge 204, an applied charging bias (Vpy) to be actually applied is calculated according to the following calculation formula.

$$\text{Applied charging bias}(Vpy)=\alpha y+\beta y+\gamma y \quad (1)$$

S115

In S115, based on the calculated applied charging bias (Vpy), the control unit 220 controls the high-voltage power supply 512 and applies a charging bias to the charging roller 2.

In Case of 1B (Only the drum memory of the drum cartridge is recognized (mounted).)

In this case, the flow proceeds in a sequence of S106, S107, S108, S111, and S115.

In other words, the flow is the same as in the case of 1A up to S106 and S107 and the first correction value βy is calculated, but since information of the developing memory 151 of the developing cartridge 204 is not obtained in S108, the flow advances to S111.

In this case, the second correction value γy in the calculation formula (1) described above becomes indeterminate. Therefore, the applied charging bias to be actually applied is determined by the following calculation formula.

$$Vpy=\alpha y+\beta y \quad (2)$$

In the case of the present first embodiment, since held values of the correction table described in Table 2 are all set to 0, this amounts to Vpy=αy.

Once the calculated applied charging bias Vpy is determined, the flow advances to S115 and the control unit 220 controls the high-voltage power supply 512 and applies a charging bias to the charging roller 2. In other words, the charging bias is applied to the charging roller 2 with αy as the charging bias Vpy.

In Case of 1C (Only the developing memory of the developing cartridge is recognized (mounted).)

In this case, the flow proceeds in a sequence of S106, S112, S113, and S115.

In other words, since information of the drum memory 150 of the drum cartridge 213 is not obtained in S106, the flow advances to S112, and when the developing memory is recognized, the flow advances to S113. In this case, βy is indeterminate in the calculation formula (1).

In S113, since use information of the drum cartridge in Table 3 is also not obtained, correction solely based on the use status of the developing cartridge 204 is performed. In this case, control is performed with an initial value of the life (the film thickness) of the photosensitive drum.

Specifically, from Table 3, with an initial value (for example, an initial drum film thickness of 25 μm) of the life of the drum cartridge, a second correction value γ'y corresponding to the life information of the developing cartridge 204 is calculated and the applied charging bias to be actually applied is determined according to the following calculation formula.

$$Vpy=\alpha y+\gamma' y \quad (3)$$

In Case of 1D (Neither the drum memory of the drum cartridge nor the developing memory of the developing cartridge are recognized (mounted).)

In this case, the flow proceeds in a sequence of S106, S112, S114, and S115.

Specifically, both the step of recognition of the drum memory 150 (S106) and the step of recognition of the developing memory 151 (S112) result in (absent) and the flow advances to S114.

In this case, since neither the drum memory 150 nor the developing memory 151 can be recognized, both βy and γy in the calculation formula (1) become indeterminate.

Therefore, the applied charging bias Vpy is controlled at a bias described in Table 16 set to the main body controller 201 in advance.

As a result, a bias is applied to the charging roller 2 at the charging bias Vpy calculated by the main body controller 201.

Figure 12:
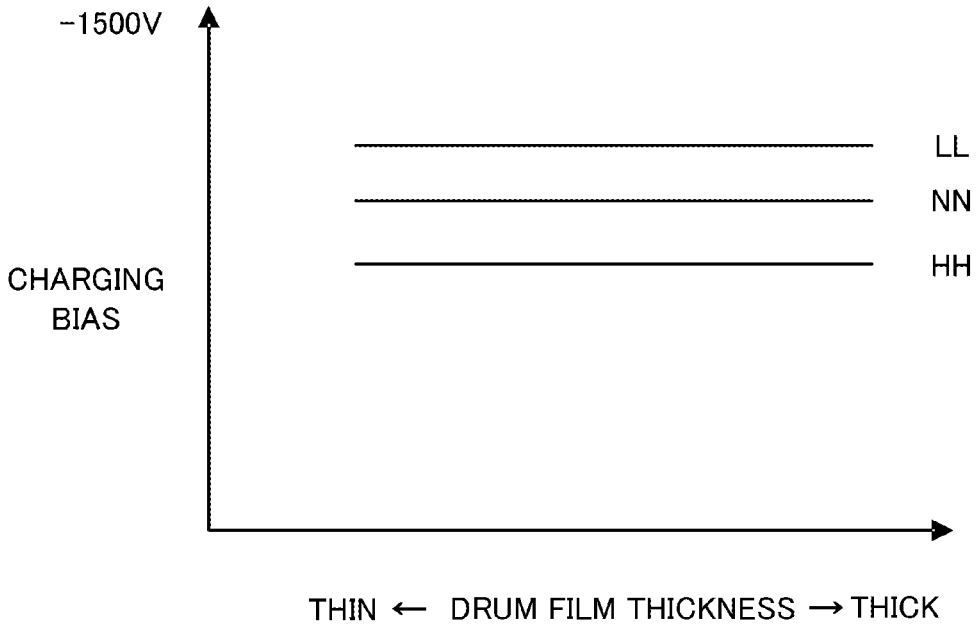
FIG. 12 is a graph of a charging bias when the correction shown in FIG. 6 is absent.

Table 16 shows a table holding reference charging biases when a memory tag is indeterminate. It should be noted that operations are commonly controlled among 1st to 4st. Since the life of the photosensitive drum 1 is indeterminate, a charging bias which enables image formation is set regardless of the drum film thickness. FIG. 12 shows a corresponding graph.

TABLE 16

| ENVIRONMENT | | |
|---|---|---|
| N N | L L | H H |
| −1050 | −1100 | −1000 |

As described above, an image forming operation can be performed even when the drum memory 150 and the developing memory 151 are not recognized.

Next, Table 1, Table 2, and Table 3 used in the flow chart described above will be described in detail.

TABLE 1

| | | DRUM FILM THK. (μm) | | |
|---|---|---|---|---|
| | | 30 μm | 20 μm | 10 μm |
| | | 1ST | | |
| ENVR. | 11.8 | −1100 | −1050 | −1000 |
| MOISTURE | 1.1 | −1150 | −1100 | −1050 |
| CONTENT | 21.5 | −1050 | −1000 | −950 |
| | | 2ST | | |
| ENVR. | 11.8 | −1100 | −1050 | −1000 |
| MOISTURE | 1.1 | −1150 | −1100 | −1050 |
| CONTENT | 21.5 | −1050 | −1000 | −950 |
| | | 3ST | | |
| ENVR. | 11.8 | −1100 | −1050 | −1000 |
| MOISTURE | 1.1 | −1150 | −1100 | −1050 |
| CONTENT | 21.5 | −1050 | −1000 | −950 |
| | | 4ST | | |
| ENVR. | 11.8 | −1100 | −1050 | −1000 |
| MOISTURE | 1.1 | −1150 | −1100 | −1050 |
| CONTENT | 21.5 | −1050 | −1000 | −950 |

Table 1 shows tables of reference charging bias which hold data of reference charging bias (reference information of charging bias) based on drum film thickness that is life information of the photosensitive drum 1 and moisture content that is environmental information. Four tables (1st to 4st), each corresponding to each color, are held in the main body memory 221 of the main body controller 201. The description of the flow chart given above represents an example of 1st (Y station).

An abscissa of each table represents drum film thickness and respectively holds three levels of 30 μm, 20 μm, and 10 μm. When the film thickness is between the three levels, a calculation is performed based on the charge table by the control unit 220 of the main body controller 201 by linear interpolation.

An ordinate of each table represents a moisture content that is environmental information calculated by the control unit 220 from the temperature and the humidity detected by the environmental sensor 210 and holds three levels of 21.5 g under high temperature, high humidity conditions (HH) of 30° C. and 80% RH, 1.1 g under low temperature, low humidity conditions (LL) of 15° C. and 10% RH, and 11.8 g under normal temperature, normal humidity conditions of 25° C. and 60% RH. Based on moisture contents calculated from measured temperature and humidity, a moisture content between the moisture contents of the respective levels is calculated by linear interpolation. When an output value (for example, a resistance value) corresponding to the moisture content in air can be directly acquired from the environmental sensor 210, the detected value of the environmental sensor 210 may be directly used.

It should be noted that while three levels of drum film thickness and three levels of moisture content are respectively held in the present first embodiment, the number of levels is not limited thereto and may be increased or reduced in accordance with a capacity of a memory tag.

While the drum film thickness and the moisture content held in the tables are subjected to linear interpolation in consideration of errors and calculation amounts in the present first embodiment, nonlinear interpolation may be applied instead.

Figure 7:
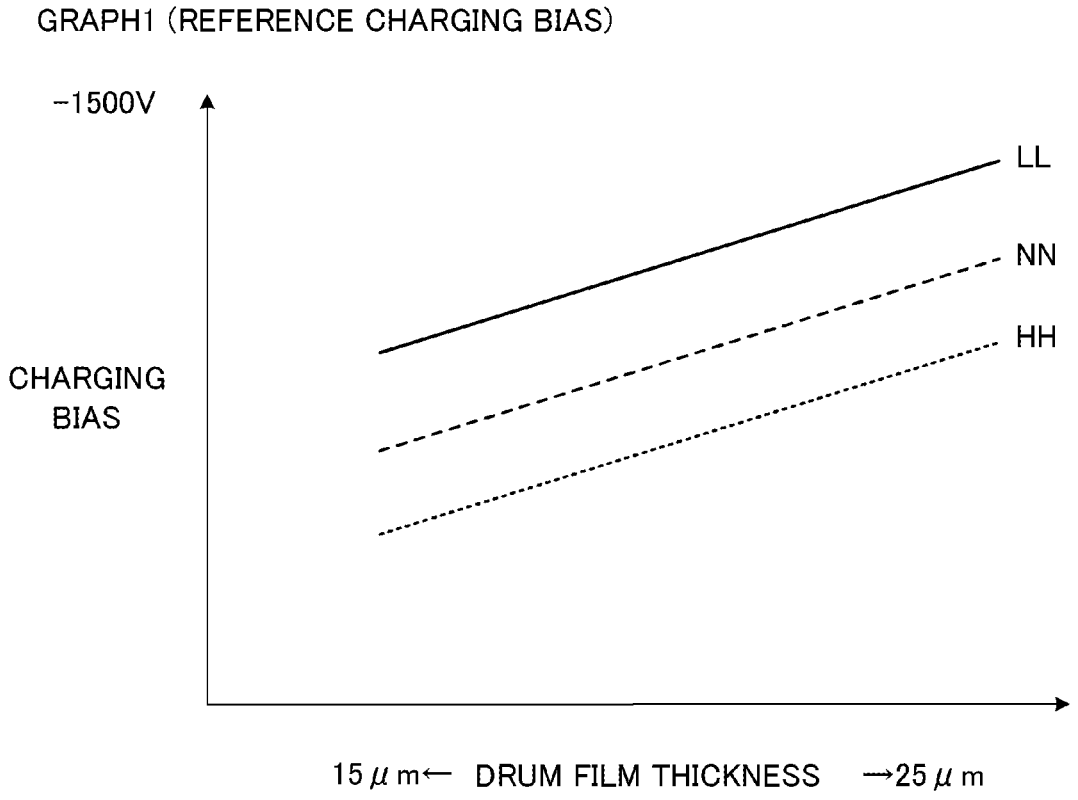
FIG. 7 is a graph of a reference charging bias according to the first embodiment.

Graph 1 shown in FIG. 7 represents a relationship among drum film thickness, charging bias, and temperature and humidity shown in Table 1.

It should be noted that the tables in Table 1 are obtained from results of an evaluation performed by the present inventors and, for example, when the used film thickness is (30 μm), the following settings are used.

HH (high temperature, high humidity): temperature 30° C., humidity 80%, applied charging voltage value −1050 V NN (normal temperature, normal humidity): temperature 25° C., humidity 60%, applied charging voltage value −1100 V LL (low temperature, low humidity): temperature 10° C., humidity 15%, applied charging voltage value −1150 V The present phenomenon can be explained by Paschen's law. Specifically, the present phenomenon is attributable to a change in relative permittivity of a photosensitive member layer due to temperature and humidity around the photosensitive member and the like causing a change in discharge start voltage.

TABLE 2

| | | DRUM FILM THK. (μm) | | |
|---|---|---|---|---|
| | | 25 μm | 20 μm | 15 μm |
| ENVR. | 11.8 | 0 | 0 | 0 |
| MOISTURE | 1.1 | 0 | 0 | 0 |
| CONTENT | 21.5 | 0 | 0 | 0 |

Table 2 is a correction table holding first correction information based on drum film thickness that is life information of the photosensitive drum 1 held in the drum memory 150 of the drum cartridge 213 and moisture content that is environmental information.

An abscissa of the correction table represents drum film thickness (life information of the photosensitive drum) and respectively holds three levels of 30 μm, 20 μm, and 10 μm. When the film thickness is between the three levels, a calculation is performed based on the charge table by the control unit 220 of the main body controller 201 by linear interpolation.

An ordinate of the correction table represents a moisture content that is environmental information calculated by the control unit 220 from the temperature and the humidity detected by the environmental sensor 210 and, in a similar manner to Table 1, holds three levels of 21.5 g under high temperature, high humidity conditions (HH), 1.1 g under low temperature, low humidity conditions (LL), and 11.8 g under normal temperature, normal humidity conditions (NN). Based on moisture contents calculated from detected temperature and humidity, a moisture content between the moisture contents of the respective levels is calculated by linear interpolation.

In the present first embodiment, held values of the correction table in Table 2 are all set to 0. In other words, the present first embodiment assumes a case where the influence in variability of assembly during production is small and correction of a charging bias in accordance with specific information of the drum cartridge 213 is not performed.

Although held values of the correction table in Table 2 are all set to 0 in the present first embodiment, Table 2 is a correction table based on information specific to the drum cartridge 213 and is capable of holding correction information based on specific information.

Figure 8:
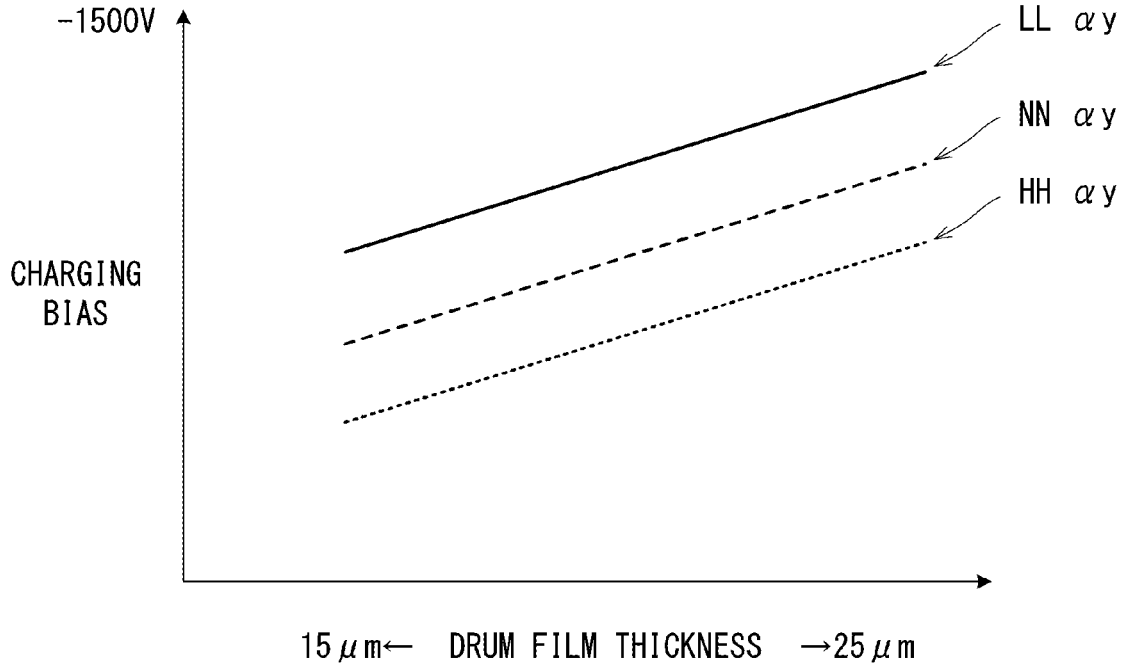
FIG. 8 is a graph of a charging bias added with a first correction value according to the first embodiment.
Figure 13:
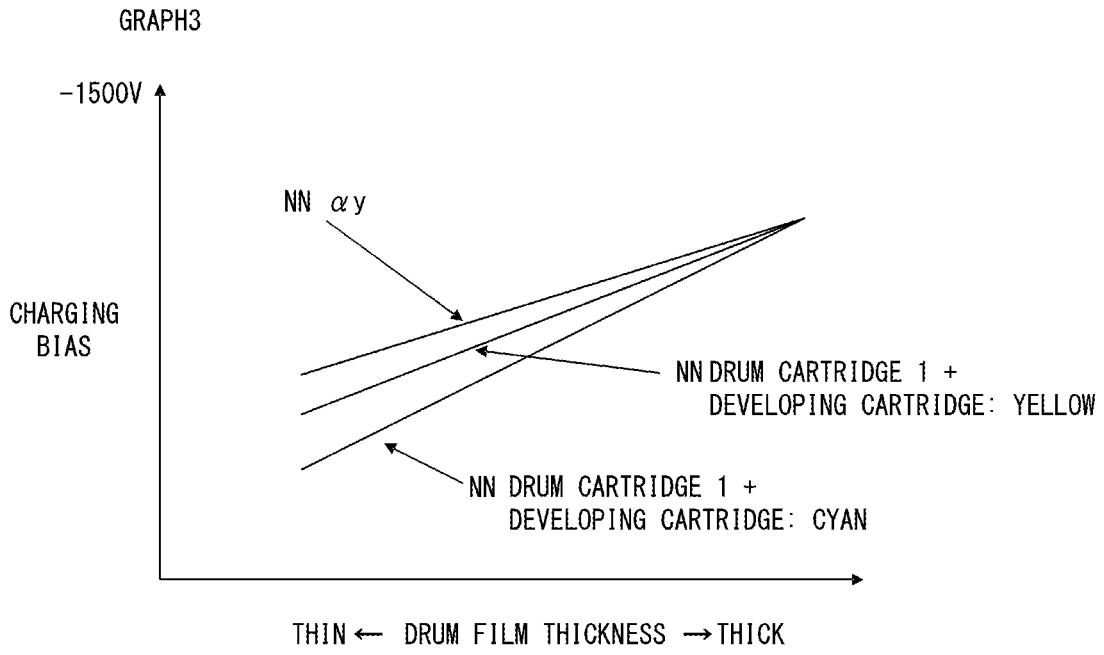
FIG. 13 is a graph of a charging bias when the color shown in FIG. 7 differs.

FIG. 8 is a graph obtained by adding the first correction value βy to the reference charging bias value αy of Graph 1, and since the first correction value βy is 0, Graph 2 is the same as Graph 1. FIG. 13 is a graph of a reference charging bias when the color is different.

TABLE 3

| | | DRUM FILM THK. (μm) | | |
|---|---|---|---|---|
| | | 25 μm | 20 μm | 15 μm |
| YELLOW MOISTURE AMNT. 1.1 | | | | |
| DEVELOPING LIFE % | 100%~90% | 0 | 0 | 0 |
| | 90%~40% | 0 | −20 | −20 |
| | 40%~0% | −20 | −40 | −40 |
| YELLOW MOISTURE AMNT. 11.8 | | | | |
| DEVELOPING LIFE % | 100%~90% | 0 | 0 | 0 |
| | 90%~40% | 0 | −16 | −15 |
| | 40%~0% | −20 | −20 | −20 |
| YELLOW MOISTURE AMNT. 21.5 | | | | |
| DEVELOPING LIFE % | 100%~90% | 0 | 0 | 0 |
| | 90%~40% | 0 | 0 | 0 |
| | 40%~0% | 0 | 0 | 0 |
| MAGENTA MOISTURE AMNT. 1.1 | | | | |
| DEVELOPING LIFE % | 100%~90% | 0 | 0 | 0 |
| | 90%~40% | −20 | −20 | −20 |
| | 40%~0% | −40 | −40 | −40 |
| MAGENTA MOISTURE AMNT. 11.8 | | | | |
| DEVELOPING LIFE % | 100%~90% | 0 | 0 | 0 |
| | 90%~40% | −25 | −25 | −25 |
| | 40%~0% | −25 | −25 | −25 |
| MAGENTA MOISTURE AMNT. 21.5 | | | | |
| DEVELOPING LIFE % | 100%~90% | 0 | 0 | 0 |
| | 90%~40% | 0 | 0 | 0 |
| | 40%~0% | 0 | 0 | 0 |
| CYAN MOISTURE AMNT. 1.1 | | | | |
| DEVELOPING LIFE % | 100%~90% | 0 | 0 | 0 |
| | 90%~40% | −20 | −20 | −20 |
| | 40%~0% | −40 | −40 | −40 |
| CYAN MOISTURE AMNT. 11.8 | | | | |
| DEVELOPING LIFE % | 100%~90% | 0 | 0 | 0 |
| | 90%~40% | −25 | −25 | −25 |
| | 40%~0% | −25 | −25 | −25 |
| CYAN MOISTURE AMNT. 21.5 | | | | |
| DEVELOPING LIFE % | 100%~90% | 0 | 0 | 0 |
| | 90%~40% | 0 | 0 | 0 |
| | 40%~0% | 0 | 0 | 0 |
| BLACK MOISTURE AMNT. 1.1 | | | | |
| DEVELOPING LIFE % | 100%~90% | 0 | 0 | 0 |
| | 90%~40% | −20 | −20 | −20 |
| | 40%~0% | −40 | −40 | −40 |
| BLACK MOISTURE AMNT. 11.8 | | | | |
| DEVELOPING LIFE % | 100%~90% | 0 | 0 | 0 |
| | 90%~40% | −15 | −15 | −15 |
| | 40%~0% | −15 | −15 | −15 |
| BLACK MOISTURE AMNT. 21.5 | | | | |
| DEVELOPING LIFE % | 100%~90% | 0 | 0 | 0 |
| | 90%~40% | 0 | 0 | 0 |
| | 40%~0% | 0 | 0 | 0 |

Table 3 shows held values of correction tables of a plurality of pieces of second correction information held in the respective developing memories 151 of the developing cartridges 204 of four colors.

The correction tables are tables for predicting staining according to a drum film thickness of the photosensitive drum 1 of the drum cartridge 213 and a developing life of the developing cartridge 204. Specifically, since staining of the charging roller 2 changes due to the toner used, capacitance changes and discharge start voltage also changes. In consideration of this phenomenon, a correction value for correcting a decrease in potential is held in the correction table of the drum cartridge 213 of each color so that a desired dark-part potential is obtained.

The correction tables have three tables corresponding to moisture contents of three levels for each color or, in other words, 12 tables for 4 colors. The three levels of moisture contents are 21.5 g under high temperature, high humidity conditions (HH), 1.1 g under low temperature, low humidity conditions (LL), and 11.8 g under normal temperature, normal humidity conditions (NN).

An abscissa of the correction tables represents drum film thickness that is drum life and respectively holds three levels of 30 μm, 20 μm, and 10 μm. When the film thickness is between the three levels, a calculation is performed by the control unit 220 of the main body controller 201 by linear interpolation in a similar manner to the charge table.

An ordinate of the correction tables represents developing life and is divided into three levels of 100% to 90, 90% to 40%, and 40% to 0%. The ordinate of the correction tables may be replaced with a drive amount (the number of revolutions or a drive time) instead of remaining developing life.

Figure 9A:
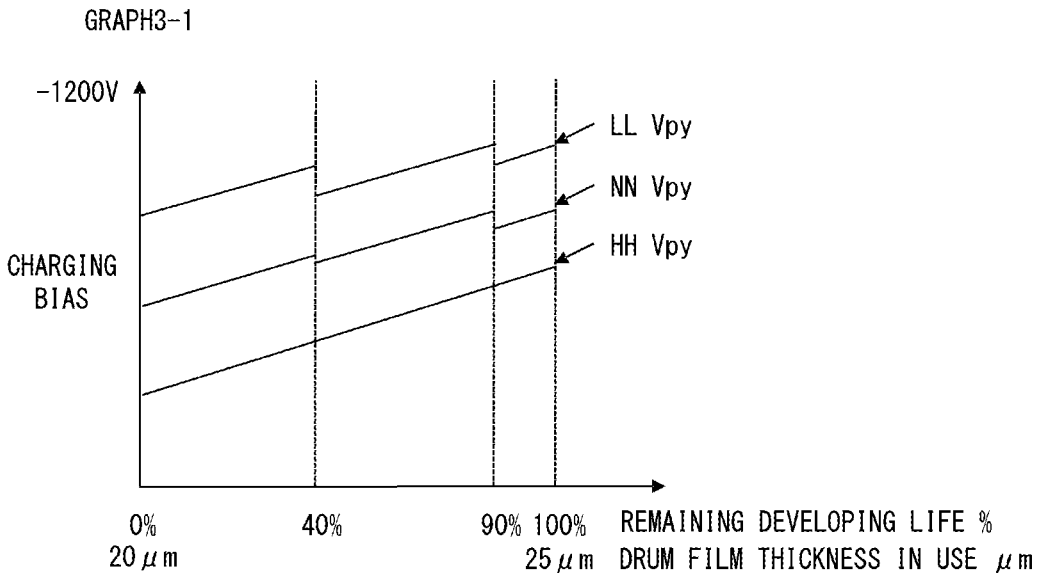
FIGS. 9A and 9B are graphs of a charging bias added with a second correction value according to the first embodiment.
Figure 9B:
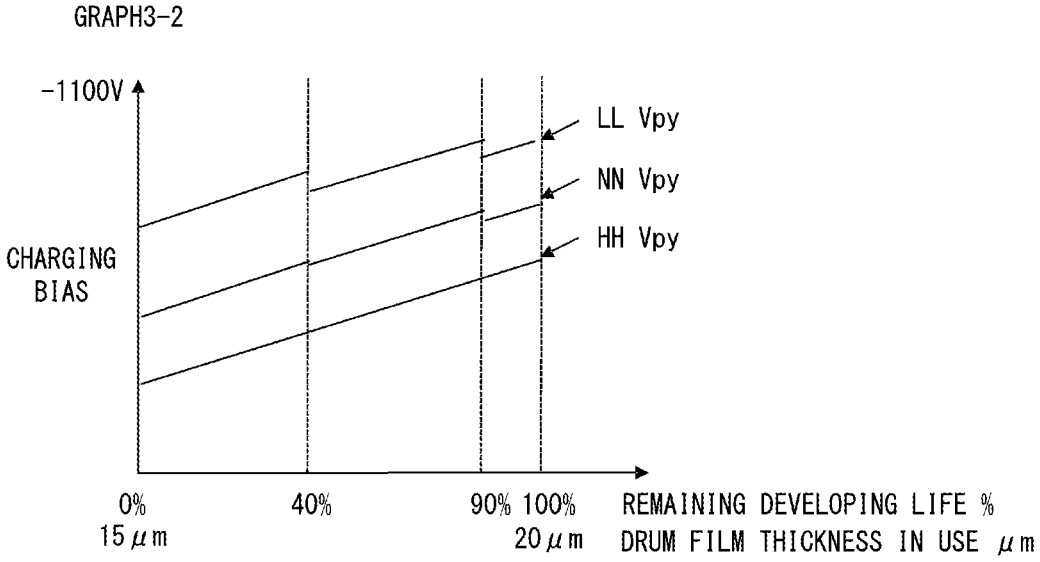

Graphs 3-1 and 3-2 shown in FIGS. 9A and 9B represent a relationship among drum film thickness, charging bias, and temperature and humidity corresponding to Table 3.

Graphs 3-1 and 3-2 are graphs for explaining the correction tables in Table 3 and correspond to the three tables for the respective moisture contents of yellow in Table 3.

The photosensitive drum 1 and the developing cartridge 204 are configured such that the life of the photosensitive drum 1 is longer than the life of the developing cartridge 204 and the developing cartridge 204 is replaced midway through the life of the photosensitive drum 1. In addition, the correction tables of Table 3 which constitute the second correction information are set in advance in accordance with drum film thickness that is drum life and the developing life (the life information) of each of the plurality of developing cartridges 204 to be replaced. In this example, two developing cartridges 204 are used.

Graph 3-1 represents a shift in charging bias when the drum cartridge 213 and the developing cartridge 204 were both brand-new at start of use.

In other words, Graph 3-1 is a graph of charging bias control when paper is passed through the yellow developing cartridge 204 until the drum film thickness is reduced from 25 μm to 20 μm.

A relationship between developing life and drum film thickness is such that, when the developing cartridge 204 is in a brand-new state and two sheets of A4 paper are passed through intermittently, the developing life decreases from 100% to 0% and reaches replacement life. In this case, the drum film thickness of the drum cartridge 213 is set so as to decrease from 25 μm to 20 μm.

In a similar manner, Graph 3-2 is a graph of charging bias control when the developing cartridge 204 is replaced with a brand-new developing cartridge 204 once the drum film thickness of the drum cartridge 213 reaches 20 μm and paper is passed through the developing cartridge 204 so that developing life is used up by the time the drum film thickness reaches 15 μm.

Both Graphs 3-1 and 3-2 show a state where a correction value is added and correction is performed to a proper charging bias Vpy at 90% and 40% shown in the yellow correction table in Table 3.

Specifically, the applied charging bias (Vpy) is controlled as indicated by the Graphs 3-1 and 3-2 based on the second correction value (γy) which corresponds to the information on moisture detected by the environmental sensor 310, the developing life, and the drum film thickness.

As described above, an appropriate charging bias Vpy can be obtained by combining the first correction value βy in accordance with the moisture content (the temperature and humidity) in air during use and the drum film thickness of the drum cartridge 213 with the second correction value γy in accordance with the moisture content (the temperature and humidity) in air during use and the developing life of the developing cartridge 204. In addition, performing such control enables the surface potential of the photosensitive drum to be kept stable over a long period of time.

Other Embodiments

Next, other embodiments of the present invention will be described. The following description will mainly focus on differences from the first embodiment and descriptions of same configurations and actions will be omitted.

Second Embodiment

First, a second embodiment of the present invention will be described.

The correction control of charging bias according to the present second embodiment takes into consideration four cartridges with different characteristics with respect to the drum cartridge 213. In particular, a variability in characteristics due to a combination of the photosensitive drum 1 and the charging roller 2 which are key components of the drum cartridge 213 is taken into consideration.

This approach is preferable when holding specific information at the time of production of the drum cartridge, and holding the first correction value that takes a specific variability at the time of production of the drum cartridge into consideration enables correction accuracy to be increased as compared to the first embodiment.

In other words, the drum memory 150 of the drum cartridge 213 has a correction table specific to the drum cartridge. When the correction table needs to be changed at the time of production of the drum cartridge 213, the drum memory 150 holds a correction value in consideration of a variability in characteristics of the drum cartridge 213 specific to the time of production.

Information held by the drum memory 150 is based on data measured by various measuring instruments at the time of production of the drum cartridge. Accordingly, accuracy of correction by the image forming apparatus 200 can be further improved. On the other hand, when the variability at the time of production is limited and correction is not significantly affected by the variability, the value to be held in the drum memory 150 may be set to 0. Alternatively, information on variability at the time of production may not be held in the drum memory 150, in which case the main body controller 201 may be caused to read a default correction value of, for example, 0 from a memory and use the read default correction value.

In the present second embodiment, a combination of the photosensitive drum 1 and the charging roller 2 is assumed as specific information. Table 4 is a table based on drum film thickness and drum cartridge specific information. Depending on a combination of the photosensitive drum 1 and the charging roller 2, environmental characteristics change and a necessary charging bias changes. This is attributable to the fact that a capacitance formed by the photosensitive drum 1 and the charging roller 2 changes, and each combination of the photosensitive drum 1 and the charging roller 2 has a specific capacitance.

In addition, since an abrasion rate changes depending on hardness of the charging roller 2 or the photosensitive drum 1, an amount of reduction in drum film thickness also differs even if the number of revolutions is the same. This causes the necessary charging bias to change.

Therefore, the drum memory 150 corresponding to combinations 1-1 to 1-4 is arranged in the drum cartridge 213.

For example, when a photosensitive drum of the combination name 1-1 is manufactured, a table of the combination name 1-1 described in Table 5 is held in the drum memory 150. In a similar manner, when a drum cartridge of the combination name 1-2 is manufactured, a table of the combination name 1-2 described in Table 5 is held in the drum memory 150. When identification at the time of production is difficult, all of the pieces of information of the combinations 1-1 to 1-4 may be held in the drum memory 150 in advance.

Combinations with the drum cartridge 213 which are held in the developing memory 151 of the developing cartridge 204 hold tables of all of the combinations 1-1 to 1-4 and refer to the tables based on identification information held in the drum memory 150 of the drum cartridge 213.

TABLE 4

| | COMBINATION NAME | | | |
|---|---|---|---|---|
| | 1-1 | 1-2 | 1-3 | 1-4 |
| PHOTOSENSITIVE DRUM | A | A | B | B |
| CHARGING ROLLER | A | B | A | B |

Hereinafter, the combinations shown in Table 4 will be described.

Photosensitive Drum 1

The following two types of the photosensitive drum 1 are used.

A type: initial drum film thickness 25 μm, abrasion rate 0.8 μm/1000 sheets

B type: initial drum film thickness 22 μm, abrasion rate 0.15 μm/1000 sheets

In the present first and second embodiments, in the photosensitive drum 1 which plays a central role in an image forming process, an undercoat layer is formed on a supporter, a charge generation layer is formed on the undercoat layer, and a charge transport layer is formed on the charge generation layer. The charge transport layer favorably contains a charge transport material and a resin, and examples thereof include a polycyclic aromatic compound, a heterocyclic compound, a hydrazone compound, a styryl compound, an enamine compound, a benzidine compound, a triarylamine compound, and resins having a group derived from these substances.

Examples of resin include polyester resin, polycarbonate resin, acrylic resin, and polystyrene resin. Among these resins, polycarbonate resin and polyester resin are particularly favorable. As polyester resin, polyarylate resin is particularly favorable.

The charge transport material and the resin favorably have a content ratio (a mass ratio) of 4:10 to 20:10 and more favorably have a content ratio (a mass ratio) of 5:10 to 12:10.

In addition, the charge transport layer may contain an additive such as an antioxidant, an ultraviolet absorber, a plasticizer, a leveling agent, a slidability imparting agent, or a wear resistance improver. Specific examples include a hindered phenol compound, a hindered amine compound, a sulfur compound, a phosphorus compound, a benzophenone compound, a siloxane modified resin, a silicone oil, fluorine resin particles, polystyrene resin particles, polyethylene resin particles, silica particles, alumina particles, and boron nitride particles.

An average film thickness of the charge transport layer is favorably at least 5 lull and not more than 50 μm, more favorably at least 8 μm and not more than 40 μm, and particularly favorably at least 10 μm and not more than 30 μm. With the photosensitive drums A and B for implementing the present invention, the average film thickness is set to 25 μm in the photosensitive drum A and to 22 μm in the photosensitive drum B.

The charge transport layer can be formed by preparing a coating liquid for a charge transport layer containing the materials described above and a solvent and forming and drying a coated film of the coating liquid. Examples of the solvent used in the coating liquid include an alcohol-based solvent, a ketone-based solvent, an ether-based solvent, an ester-based solvent, and an aromatic hydrocarbon-based solvent. Among these solvents, an ether-based solvent or an aromatic hydrocarbon-based solvent is favorable.

While a laminated photosensitive member having a charge generation layer and a charge transport layer is used as the photosensitive drums used in the first and second embodiments, a single-layer photosensitive member that contains both a charge generation material and a charge transport material may be used instead. The single-layer photosensitive member can be formed by preparing a coating liquid for a photosensitive layer containing a charge generation material, a charge transport material, a resin, and a solvent and forming and drying a coated film of the coating liquid. Examples of the charge generation material, the charge transport material, and the resin are similar to the examples of materials described for the laminated photosensitive member. Using a different binder to be added to the charge transport layer enables drum hardness to be changed and, accordingly, enables an abrasion rate per a unit number of revolutions to be changed.

Charging Roller 2

The following two types of the charging roller 2 are used.

A type charging roller: surface roughness Rz 20 to 30 μm

B type charging roller: surface roughness Rz 10 to 20 μm

Charging of the photosensitive drum 1 by the charging roller 2 means that a discharge from the charging roller 2 to the surface of the photosensitive drum 1 takes place and a charge migrates. A discharge is generated when a difference in potential between the surface of the charging roller 2 and the surface of the photosensitive drum 1 exceeds Paschen's discharge limit Vpa, at which point a charge ΔQ migrates to the surface of the photosensitive drum 1 (Paschen's law). A sum of ΔQ represents a charge Q accumulated on the photosensitive drum 1. ΔQ is expressed by a relational expression of a gap (di) between the charging roller 2 and the photosensitive drum 1 and respective dielectric constants (εi) thereof. The dielectric constant changes due to hardness, resistance, and surface roughness of the charging roller 2.

Generally, components constituting the charging roller 2 need to at least include a rubber component and a conductive agent. Examples of the rubber component include epichlorohydrin rubber, EPM (ethylene-propylene rubber), EPDM (ethylene-propylene-diene rubber), norbornene rubber, NBR (nitrile rubber), chloroprene rubber, natural rubber (NR), isoprene rubber, polybutadiene rubber (BR), styrene-butadiene rubber (SBR), chlorosulfonated polyethylene, urethane rubber, styrene-based block copolymers such as SBS (styrene-butadiene-styrene block copolymer) and SEBS (styrene-ethylene-butylene-styrene block copolymer), and silicone rubber.

In addition, examples of the conductive agent include a perchlorate such as $LiClO_4$ and $NaClO_4$, an ion conductive agent such as quaternary ammonium salt, a metallic powder or a metallic fiber of aluminum, palladium, iron, copper, silver, and the like, carbon black, a metal powder or a metallic oxide such as titanium oxide, tin oxide, and zinc oxide, a metallic compound powder of copper sulfide, zinc sulfide, and the like, a powder obtained by attaching tin oxide, antimony oxide, indium oxide, molybdenum oxide, zinc, aluminum, gold, silver, copper, chromium, cobalt, iron, lead, platinum, or rhodium to a surface of a suitable particle by an electrolytic treatment, spray coating, or mixing and shaking, a carbon powder such as acetylene black, ketjen black, PAN (polyacrylonitrile)-based carbon, or pitch-based carbon, and an electroconductive agent such as carbon-coated silica, carbon-coated magnetite, carbon-coated titanium oxide, carbon-coated barium sulfate, and conductive whiskers such as carbon whisker, graphite whisker, titanium carbide whisker, conductive potassium titanate whisker, conductive barium titanate whisker, conductive titanium oxide whisker, and conductive zinc oxide whisker.

While the rubber components and the conductive agents described above may be arbitrarily combined and used, an example of a combination that is particularly favorable in terms of reducing variability in electric resistance of a base layer is epichlorohydrin rubber and an ion conductive agent.

In the present embodiment, charging rollers are manufactured using the same materials so as to contain a superficial layer binder and fine particles as a surface roughing agent. The fine particles have a volume average particle diameter of 10 to 50 μm and more favorably have a volume average particle diameter of 20 to 40 μm and may be either spherical particles or deformed particles. Furthermore, a capacity of the fine particles relative to the superficial layer binder is 10 to 100 wt %, and only the surface roughness is changed by changing an amount of the added particles. A ten-point average roughness of the surface of the charging roller 2 is Rzjis=15 to 50 (μm) and favorably Rzjis=10 to 30 (μm). In the present embodiment, the A type charging roller 2 has a roughness of 25 μm and the B type charging roller 2 has a roughness of 10 μm.

Both measurements of Rzjis were based on JIS-B0601-2001 and used the Surface Roughness Measuring Instrument SURFCORDER SE3500 manufactured by Kosaka Laboratory Ltd. Measurements were performed under conditions in a longitudinal direction including a measurement length of 8.0 mm, a cutoff value of 0.8 mm, and a measurement speed of 0.3 mm/sec.

In addition, while a correction amount for correcting a difference in dielectric constants that occurs due to a difference in the film thickness of the photosensitive drum 1 and the surface roughness of the charging roller 2 is provided in the present embodiment, a method of correction is not limited thereto and a correction table based on other parameters may also be preferably used.

Examples of the other parameters include sensitivity, hardness, and deflection of the photosensitive drum 1 and environmental characteristics of resistance and environmental characteristics of hardness of the charging roller 2.

Control Flow

Next, a flow culminating in the determination of a charging bias in the present second embodiment will be described.

The control flow is the same from (S101) to (S106) described in the first embodiment, but in S107, the control unit 220 identifies which of the combinations 1-1 to 1-4 the drum cartridge corresponds to and, for example, when the drum cartridge corresponds to the combination 1-1, the control unit 220 refers to the correction table described in Table 5 instead of Table 2, and when the drum cartridge corresponds to the combination 1-2, the control unit 220 refers to the table described in 1-2 in Table 5, and acquires the first correction value βy.

TABLE 5

| | | DRUM FILM THK. (μm) | | |
|---|---|---|---|---|
| | | 25 μm | 20 μm | 15 μm |
| YELLOW COMBINATION 1-1 | | | | |
| ENVR. | 11.8 | 0 | 0 | 0 |
| MOISTURE | 1.1 | 0 | 0 | 0 |
| CONTENT | 21.5 | 0 | 0 | 0 |
| YELLOW COMBINATION 1-2 | | | | |
| ENVR. | 11.8 | −15 | −20 | −25 |
| MOISTURE | 1.1 | −15 | −25 | −35 |
| CONTENT | 21.5 | −15 | −15 | −15 |
| MAGENTA COMBINATION 1-1 | | | | |
| ENVR. | 11.8 | 0 | 0 | 0 |
| MOISTURE | 1.1 | 0 | 0 | 0 |
| CONTENT | 21.5 | 0 | 0 | 0 |

TABLE 5-continued

| | | | | |
|---|---|---|---|---|
| MAGENTA COMBINATION 1-2 | | | | |
| ENVR. | 11.8 | −15 | −20 | −25 |
| MOISTURE | 1.1 | −15 | −25 | −35 |
| CONTENT | 21.5 | −15 | −15 | −15 |
| CYAN COMBINATION 1-1 | | | | |
| ENVR. | 11.8 | 0 | 0 | 0 |
| MOISTURE | 1.1 | 0 | 0 | 0 |
| CONTENT | 21.5 | 0 | 0 | 0 |
| CYAN COMBINATION 1-2 | | | | |
| ENVR. | 11.8 | −15 | −20 | −25 |
| MOISTURE | 1.1 | −15 | −30 | −45 |
| CONTENT | 21.5 | −15 | −15 | −15 |
| BLACK COMBINATION 1-1 | | | | |
| ENVR. | 11.8 | 0 | 0 | 0 |
| MOISTURE | 1.1 | 0 | 0 | 0 |
| CONTENT | 21.5 | 0 | 0 | 0 |
| BLACK COMBINATION 1-2 | | | | |
| ENVR. | 11.8 | −15 | −20 | −25 |
| MOISTURE | 1.1 | −15 | −25 | −35 |
| CONTENT | 21.5 | −15 | −15 | −15 |

| | | DRUM FILM THK. (μm) | | |
|---|---|---|---|---|
| | | 22 μm | 19 μm | 16 μm |
| YELLOW COMBINATION 1-3 | | | | |
| ENVR. | 11.8 | 0 | 0 | 0 |
| MOISTURE | 1.1 | 0 | 0 | 0 |
| CONTENT | 21.5 | 0 | 0 | 0 |
| YELLOW COMBINATION 1-4 | | | | |
| ENVR. | 11.8 | −20 | −25 | −30 |
| MOISTURE | 1.1 | −20 | −30 | −40 |
| CONTENT | 21.5 | −20 | −20 | −20 |
| MAGENTA COMBINATION 1-3 | | | | |
| ENVR. | 11.8 | 0 | 0 | 0 |
| MOISTURE | 1.1 | 0 | 0 | 0 |
| CONTENT | 21.5 | 0 | 0 | 0 |
| MAGENTA COMBINATION 1-4 | | | | |
| ENVR. | 11.8 | −20 | −25 | −30 |
| MOISTURE | 1.1 | −20 | −30 | −40 |
| CONTENT | 21.5 | −20 | −20 | −20 |
| CYAN COMBINATION 1-3 | | | | |
| ENVR. | 11.8 | 0 | 0 | 0 |
| MOISTURE | 1.1 | 0 | 0 | 0 |
| CONTENT | 21.5 | 0 | 0 | 0 |
| CYAN COMBINATION 1-4 | | | | |
| ENVR. | 11.8 | −20 | −25 | −30 |
| MOISTURE | 1.1 | −20 | −35 | −50 |
| CONTENT | 21.5 | −20 | −20 | −20 |
| BLACK COMBINATION 1-3 | | | | |
| ENVR. | 11.8 | 0 | 0 | 0 |
| MOISTURE | 1.1 | 0 | 0 | 0 |
| CONTENT | 21.5 | 0 | 0 | 0 |
| BLACK COMBINATION 1-4 | | | | |
| ENVR. | 11.8 | −20 | −25 | −30 |
| MOISTURE | 1.1 | −20 | −30 | −40 |
| CONTENT | 21.5 | −20 | −20 | −20 |

Meanwhile, in S108 and S109, the control unit 220 acquires use information (the life information) from the developing memory 151 of the developing cartridge 204 and acquires, from the correction table shown in Table 6, the second correction value (the second correction information) γy of the charging bias based on the temperature and humidity and the use information of the developing cartridge 204 which are held in the developing memory 151.

Subsequently, in S110, the charging bias Vpy is calculated based on the calculation formula (1).

Table 6 shows an example of a table held in the respective developing memories 151 of the developing cartridges 204 of four colors.

Specifically, the table is a staining prediction table based on the film thickness information of the drum cartridge 213 and the developing life of the developing cartridge 204, and the held values are the second correction value γy of the charging bias in the calculation formula (2) described earlier. In the present second embodiment, a table of the second correction value corresponding to the developing life is provided for each of the drum cartridges 213.

TABLE 6

| YELLOW MOISTURE AMNT. | | DRUM FILM THK. (μm) | | |
|---|---|---|---|---|
| 1.1 | 1-1 | 25 μm | 20 μm | 15 μm |
| DEVELOPING LIFE | 100%~90% | 0 | 0 | 0 |
| | 90%~40% | 0 | −20 | −20 |
| | 40%~0% | −20 | −40 | −40 |

Figure 10A:
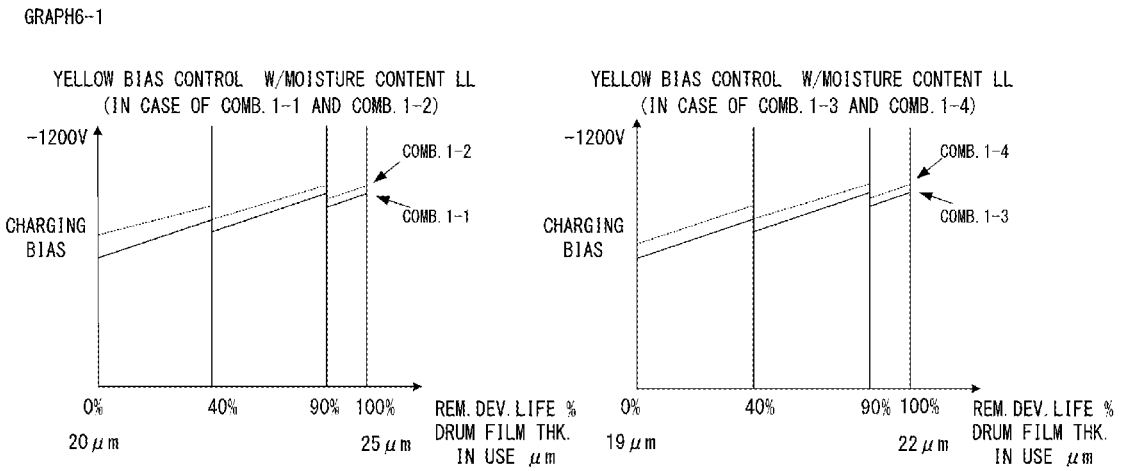
FIGS. 10A and 10B are graphs of a charging bias added with a second correction value according to a second embodiment.
Figure 10B:
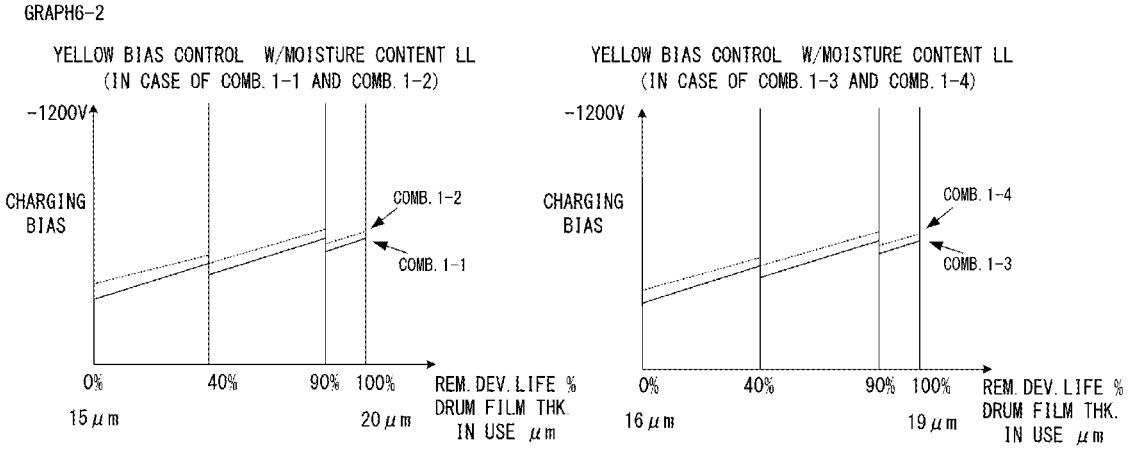

FIGS. 10A and 10B show Graphs 6-1 and 6-2 for explaining held values of the correction table in Table 6.

Graph 6-1 corresponds to the table in Table 6. Specifically, Table 6 corresponds to the yellow station in terms of toner, the drum cartridge combination of (1-1), and the moisture content LL, and similar tables are also provided for the other moisture contents of (NN) and (HH). Furthermore, similar tables are also held for the other combinations of (1-2), (1-3), and (1-4).

In the present second embodiment, in a similar manner to the first embodiment, the Graph 6-1 represents a shift in charging bias control when a durability test involving intermittently passing two sheets of A4 paper through the yellow developing cartridge is performed using the specifications of the drum cartridge based on Table 4.

Graph 6-1 represents a shift in charging bias when the yellow developing cartridge is used until the drum film thickness decreases to 20 μm from 25 μm at the specifications of the combinations 1-1 and 1-2 in Table 4. Graph 6-2 represents a shift in charging bias when the yellow developing cartridge is used until the drum film thickness decreases to 15 μm from 20 μm at the specifications of the combinations 1-1 and 1-2 described in Table 4.

Both Graphs 6-1 and 6-2 show a state where a correction value is added and correction is performed to a proper charging bias Vpy at the developing lives of 90% and 40% shown in Table 6.

As described above, the present second embodiment is capable of keeping the potential of the photosensitive drum 1 stable over a long period of time until the replacement life ends even if variability is present in the drum cartridge 213.

Next, the following verification test was performed in order to verify effects of the present first and second embodiments.

Verification Test

A drum cartridge having a drum memory and a developing cartridge having a developing memory holding the correction information according to the present first and second embodiments were used as the two-body cartridges to be used in the electrophotographic system image forming apparatus shown in FIG. 1. The presence or absence of an occurrence of an abnormal image was verified while performing a durability test involving intermittently passing sheets of paper.

In a low temperature, low humidity environment (L/L: 15° C./10% RH), the image forming apparatus intermittently printed images on 30000 sheets of A4 paper (from developing life 100% to 0%) at a print percentage of 1%, and images were evaluated. An item of image defect refers to a so-called fogged image in which toner is developed on a solid white image. A measurement of a fogging amount was quantified by applying a transparent tape on the surface of the photosensitive drum and subsequently measuring the tape with a reflection densitometer (TC-6DS manufactured by Tokyo Denshoku CO., LTD.). In the present embodiment, since fogging in unacceptable image density occurred on paper when fogging on the photosensitive drum was 5% or higher, 5% or higher was determined to be unacceptable (indicated with "X") and lower than 5% was determined to be acceptable (indicated with "0").

Verification 1-1

Table 7 shows results of an occurrence of image defects for combinations of the developing cartridge and the drum cartridge and charge control during paper passing (first embodiment ("EMBT.1"), second embodiment ("EMBT.2"), and control flows 1B, 1C, 1D, 2B, 2C, and 2D).

The results were obtained by using both the developing cartridge and the drum cartridge from brand-new states and passing paper until the developing cartridge reached a developing life of 0% and, with respect to the drum cartridge, the film thickness of the drum A decreased from 25 μm to 20 μm and the film thickness of the drum A decreased from 22 μm to 19 μm.

% in the table indicates a developing life % at the time of occurrence of an abnormal image, and the sign "O" indicates that an abnormal image has not occurred.

TABLE 7

| DEVELOPING CARTRIDGE | DRUM CARTRIDGE COMBINATION | RESULT (CORRECTION CONTROL/IMAGE DEFECT OCCURRENCE TIMING) | | | | | | | |
|---|---|---|---|---|---|---|---|---|---|
| Yellow | 1-1 | EMBT.1/O | EMBT.2/O | 1B/3% | 1C/2% | 1D/5% | 2B/1% | 2C/6% | 2D/19% |
| Yellow | 1-2 | EMBT.1/O | EMBT.2/O | 1B/5% | 1C/7% | 1D/5% | 2B/3% | 2C/10% | 2D/28% |
| Yellow | 1-3 | EMBT.1/O | EMBT.2/O | 1B/10% | 1C/12% | 1D/5% | 2B/9% | 2C/9% | 2D/31% |
| Yellow | 1-4 | EMBT.1/O | EMBT.2/O | 1B/12% | 1C/11% | 1D/5% | 2B/8% | 2C/11% | 2D/33% |
| Mgenta | 1-1 | EMBT.1/O | EMBT.2/O | 1B/9% | 1C/10% | 1D/5% | 2B/5% | 2C/7% | 2D/30% |
| Mgenta | 1-2 | EMBT.1/O | EMBT.2/O | 1B/14% | 1C/12% | 1D/5% | 2B/6% | 2C/9% | 2D/28% |
| Mgenta | 1-3 | EMBT.1/O | EMBT.2/O | 1B/16% | 1C/21% | 1D/5% | 2B/8% | 2C/11% | 2D/25% |
| Mgenta | 1-4 | EMBT.1/O | EMBT.2/O | 1B/19% | 1C/12% | 1D/5% | 2B/9% | 2C/12% | 2D/19% |
| Cyan | 1-1 | EMBT.1/O | EMBT.2/O | 1B/11% | 1C/4% | 1D/5% | 2B/8% | 2C/18% | 2D/17% |
| Cyan | 1-2 | EMBT.1/O | EMBT.2/O | 1B/14% | 1C/2% | 1D/5% | 2B/7% | 2C/22% | 2D/16% |

TABLE 7-continued

| DEVELOPING CARTRIDGE | DRUM CARTRIDGE COMBINATION | RESULT (CORRECTION CONTROL/IMAGE DEFECT OCCURRENCE TIMING) | | | | | | | |
|---|---|---|---|---|---|---|---|---|---|
| Cyan | 1-3 | EMBT.1/O | EMBT.2/O | 1B/15% | 1C/13% | 1D/5% | 2B/16% | 2C/28% | 2D/22% |
| Cyan | 1-4 | EMBT.1/O | EMBT.2/O | 1B/20% | 1C/17% | 1D/5% | 2B/19% | 2C/31% | 2D/35% |
| Black | 1-1 | EMBT.1/O | EMBT.2/O | 1B/15% | 1C/2% | 1D/5% | 2B/10% | 2C/15% | 2D/11% |
| Black | 1-2 | EMBT.1/O | EMBT.2/O | 1B/10% | 1C/9% | 1D/5% | 2B/9% | 2C/19% | 2D/19% |
| Black | 1-3 | EMBT.1/O | EMBT.2/O | 1B/8% | 1C/7% | 1D/5% | 2B/11% | 2C/21% | 2D/22% |
| Black | 1-4 | EMBT.1/O | EMBT.2/O | 1B/5% | 1C/5% | 1D/5% | 2B/9% | 2C/23% | 2D/20% |

Result of Verification 1-1

Table 7 shows that, in the present first and second embodiments, appropriate charging bias control can be performed without image defects. On the other hand, it is shown that, in the control flows 1B, 1C, 1D, 2B, 2C, and 2D, charging potential deviates and fogging occurs as the developing durability test progresses. This is mainly due to a difference in staining of the charging roller and a difference in characteristics of the drum cartridge. With the present first and second embodiments, since charging bias is controlled in consideration of the above, a stable drum potential can be obtained throughout the entire lives of the developing cartridge and the drum cartridge.

Verification 1-2

Next, verification 1-2 will be described.

In a similar manner to verification 1-1, verification 1-2 verified results of an occurrence of image defects for combinations of the developing cartridge and the drum cartridge and charge control during paper passing (first embodiment, second embodiment, and control flows 1B, 1C, 1D, 2B, 2C, and 2D). In verification 1-2, a drum cartridge midway through its product life was used.

In Table 8, the developing cartridge was used from its brand-new state, the drum cartridge A had a film thickness of 20 μm at the start of use, and the drum cartridge B had a film thickness of 19 μm at the start of use. The results were obtained by passing paper until the developing cartridge reached a developing life of 0%, the film thickness of the drum cartridge A decreased from 20 μm to 15 μm, and the film thickness of the drum cartridge B decreased from 19 μm to 16 μm.

performed without image defects. On the other hand, faulty charging had occurred in all of the control flows 1B, 1C, 1D, 2B, 2C, and 2D.

Table 8 shows that, in an advanced state of durability deterioration of the photosensitive drum 1, a desired charging potential cannot be obtained even when a brand-new developing cartridge 204 is used. When the durability test proceeds in this state, a difference in potential is created even when the same toner is used in the durability test. Even in this state, since charging bias is controlled in consideration of the above in the mode of the present first and second embodiments, a stable drum potential can be obtained throughout the entire life of the developing cartridge 204.

Third Embodiment

Next, a third embodiment of the present invention will be described.

In the configurations of the first and second embodiments described above, when a matrix of the drum cartridge 213 is greatly diversified, it may be difficult in terms of storage capacity to have the drum memory 150 hold all of the patterns of correction control. In addition, in cases where a drum cartridge product is added after the image forming apparatus becomes commercially available such as when a drum film thickness is changed or when a charging roller with different characteristics is sold as a drum cartridge, it is conceivable that memory tag information held in the image forming apparatus or the developing cartridge that is already commercially available may not be capable of charging bias optimization.

TABLE 8

| DEVELOPING CARTRIDGE | DRUM CARTRIDGE COMBINATION | RESULT(CORRECTION CONTROL/IMAGE DEFECT OCCURRENCE TIMING) | | | | | | | |
|---|---|---|---|---|---|---|---|---|---|
| Yellow | 1-1 | EMBT.1/O | EMBT.2/O | 1B/55% | 1C/52% | 1D/85% | 2B/55% | 2C/56% | 2D/79% |
| Yellow | 1-2 | EMBT.1/O | EMBT.2/O | 1B/53% | 1C/41% | 1D/77% | 2B/53% | 2C/58% | 2D/88% |
| Yellow | 1-3 | EMBT.1/O | EMBT.2/O | 1B/40% | 1C/36% | 1D/89% | 2B/47% | 2C/69% | 2D/71% |
| Yellow | 1-4 | EMBT.1/O | EMBT.2/O | 1B/52% | 1C/33% | 1D/87% | 2B/47% | 2C/61% | 2D/70% |
| Mgenta | 1-1 | EMBT.1/O | EMBT.2/O | 1B/49% | 1C/70% | 1D/88% | 2B/77% | 2C/77% | 2D/80% |
| Mgenta | 1-2 | EMBT.1/O | EMBT.2/O | 1B/54% | 1C/66% | 1D/95% | 2B/76% | 2C/79% | 2D/89% |
| Mgenta | 1-3 | EMBT.1/O | EMBT.2/O | 1B/66% | 1C/61% | 1D/87% | 2B/89% | 2C/81% | 2D/95% |
| Mgenta | 1-4 | EMBT.1/O | EMBT.2/O | 1B/79% | 1C/48% | 1D/92% | 2B/81% | 2C/82% | 2D/79% |
| Cyan | 1-1 | EMBT.1/O | EMBT.2/O | 1B/71% | 1C/84% | 1D/77% | 2B/83% | 2C/88% | 2D/87% |
| Cyan | 1-2 | EMBT.1/O | EMBT.2/O | 1B/73% | 1C/92% | 1D/92% | 2B/87% | 2C/93% | 2D/95% |
| Cyan | 1-3 | EMBT.1/O | EMBT.2/O | 1B/52% | 1C/88% | 1D/88% | 2B/76% | 2C/95% | 2D/93% |
| Cyan | 1-4 | EMBT.1/O | EMBT.2/O | 1B/49% | 1C/87% | 1D/77% | 2B/79% | 2C/81% | 2D/89% |
| Black | 1-1 | EMBT.1/O | EMBT.2/O | 1B/37% | 1C/29% | 1D/65% | 2B/50% | 2C/68% | 2D/88% |
| Black | 1-2 | EMBT.1/O | EMBT.2/O | 1B/49% | 1C/72% | 1D/51% | 2B/49% | 2C/69% | 2D/79% |
| Black | 1-3 | EMBT.1/O | EMBT.2/O | 1B/48% | 1C/70% | 1D/57% | 2B/51% | 2C/71% | 2D/59% |
| Black | 1-4 | EMBT.1/O | EMBT.2/O | 1B/50% | 1C/68% | 1D/60% | 2B/52% | 2C/73% | 2D/75% |

Result of Verification 1-2

As shown in Table 8, in the present first and second embodiments, appropriate charging bias control can be A feature of the present third embodiment is that the drum memory 150 of the drum cartridge 213 is configured to hold staining prediction information of all colors which even takes into consideration differences in staining due to the toner used in each of the drum cartridges 213.

Staining of the charging roller 2 due to a developer container will now be described.

The developing cartridge 204 according to the present third embodiment is provided with the developing blade 21 as a developer regulating member which regulates an amount of toner to be borne by the developing roller 17. The developing blade 21 is constituted by a metal thin plate made of SUS and is provided so that a vicinity of a tip on a free end-side comes into surface contact with an outer circumferential surface of the developing roller 17 by prescribed pressure. The toner borne on the developing roller 17 is imparted with a desired charge due to triboelectric charging and regulated to a thin layer when passing a contact region with the developing blade 21. A layer of the toner borne on the developing roller 17 is regulated to a thickness of 6 μm to 20 μm by the developing blade 21.

However, when the toner is unable to obtain the desired charge, a problem known as fogging occurs in which the toner ends up being developed on a solid white background. When fogging occurs, toner recovered by the cleaning blade 6 of the drum cartridge 213 increases and staining of the charging roller 2 also worsens.

When the charging roller 2 becomes stained in this manner, a charging capability of the charging roller 2 declines, a dark-part potential of the photosensitive drum 1 changes, and fogging also changes.

In addition, with a full-color image forming apparatus, charging characteristics differ depending on a pigment or an external additive used in toners. Therefore, a difference in fogging also occurs due to a difference in charging characteristics as a result of using a different toner.

Although the life of the drum cartridge 213 cannot be extended when the present phenomenon occurs with the two-body cartridge that is a feature of the present invention and, particularly, when the life of the drum cartridge 213 is longer than the life of the developing cartridge 204, the present invention offers a solution to this problem.

Specifically, contrary to the first and second embodiments, the first correction information held in the drum memory 150 is set in advance in accordance with the drum film thickness (the life information) of the photosensitive drum 1 and the developing life (the life information) of the developing cartridge. On the other hand, correction information set in advance in accordance with the developing life of the developing unit is adopted as the second correction information held in the developing memory 151.

In a similar manner to the first and second embodiments, the photosensitive drum 1 and the developing cartridge 204 are configured such that the life of the photosensitive drum 1 is longer than the life of the developing cartridge 204 and the developing cartridge 204 is replaced midway through the life of the photosensitive drum 1. In addition, the first correction information is correction information set in advance in accordance with the drum film thickness of the photosensitive drum 1 and the respective pieces of life information of the plurality of developing cartridges 204 to be replaced.

Flow Culminating in Determination of Charging Voltage Control

Figure 11:
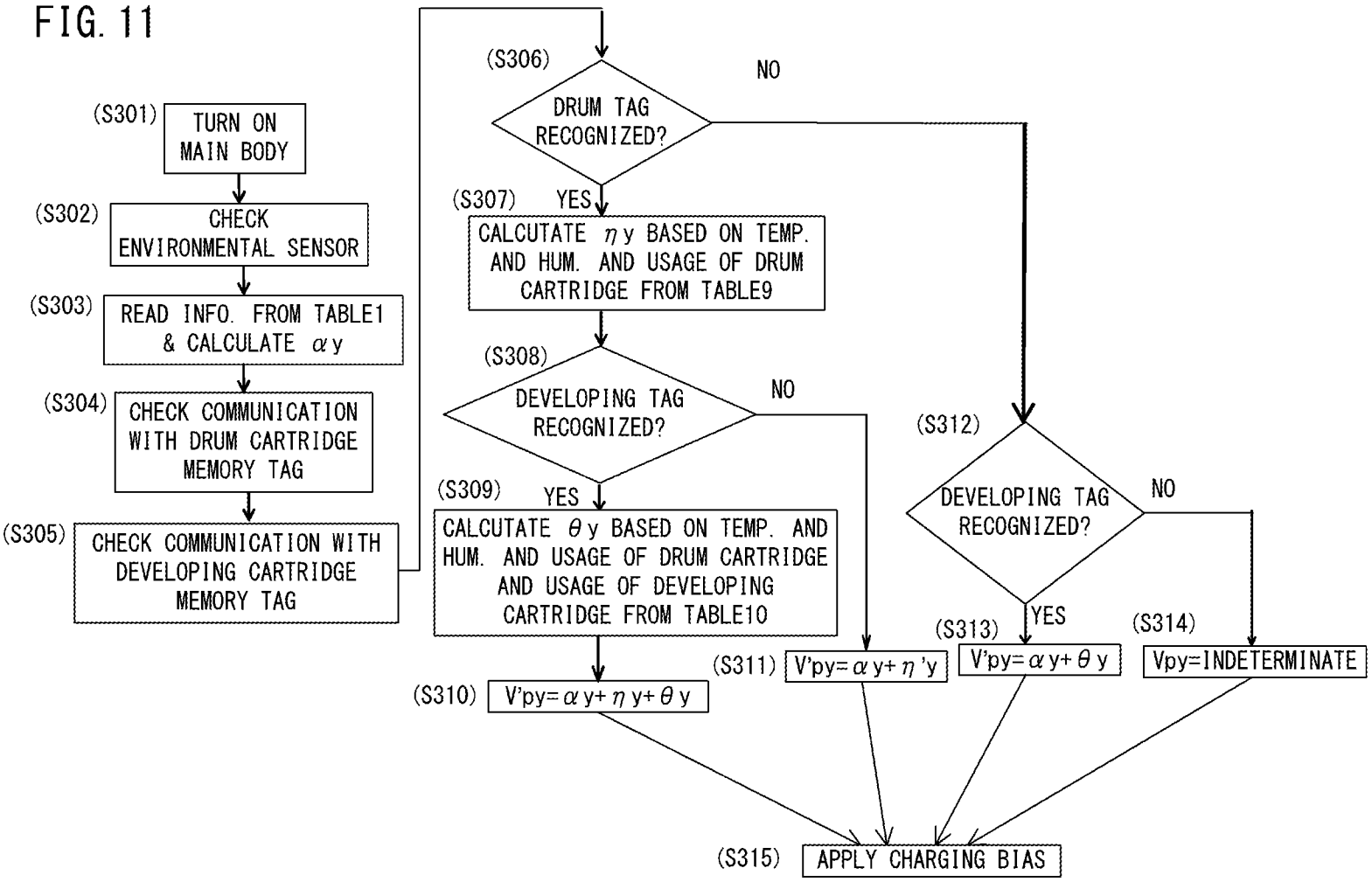
FIG. 11 is a flow chart of correction control according to a third embodiment.

Hereinafter, a flow of charging bias control according to the present third embodiment will be described according to the flow chart shown in FIG. 11. In the present third embodiment, an operation of 1st (Y station) in the image forming apparatus 200 will be similarly described. In addition, since operations of 2st to 4st are controlled by a similar flow, detailed descriptions thereof will be omitted.

S301

In S301, the main body power supply of the image forming apparatus 200 is turned on. Accordingly, the control unit 220 starts charging bias control based on the control program stored in the main body memory 221.

S302

In S302, the control unit 220 checks the environmental sensor 210, acquires information on temperature and humidity inside the image forming apparatus 200 as detected by the environmental sensor 210, and calculates an absolute moisture content (hereinafter, referred to as a moisture content) in air as environmental information.

S303

In S303, the control unit 220 reads information (αy) on a reference charging bias corresponding to the calculated moisture content from the charge table shown in Table 1. In a similar manner to the first embodiment, the charging bias Vpy=αy is held in the main body memory 221 of the main body controller 201 as a charge table based on film thickness information of the drum and environmental information.

S304

In S304, the control unit 220 communicates with the drum memory 150 of the drum cartridge 213 and checks the drum memory 150.

S305

In S305, the control unit 220 communicates with the developing memory 151 of the developing cartridge 204 and checks the developing memory 151.

Hereinafter, control differs according to a classification of a presence or absence of the drum memory and the developing memory.

3A: Both the drum memory 150 of the drum cartridge 213 and the developing memory 151 of the developing cartridge 204 are recognized 3B: Only the drum memory 150 of the drum cartridge 213 is recognized (mounted)

3C: Only the developing memory 151 of the developing cartridge 204 is recognized (mounted)

3D: Neither the drum memory 150 of the drum cartridge 213 nor the developing memory 151 of the developing cartridge 204 are recognized (mounted)

In Case of 3A

In this case, the flow proceeds in a sequence of S306, S307, S308, S309, S310, and S315.

S306, S307

S307

When a use status of the developing cartridge 204 is confirmed in S306, the flow advances to S307 and a first correction value ηy based on the temperature and humidity held in the drum memory 150 of the drum cartridge 213, the life information of the developing cartridge 204, and the film thickness information (the life information) of the drum cartridge 213 is calculated from Table 9.

TABLE 9

| | | DRUM FILM THK. (μm) | | |
|---|---|---|---|---|
| | | 25 μm | 20 μm | 15 μm |
| CYAN MOISTURE AMNT. 1.1 | | | | |
| DEVELOPING LIFE % | 100%~90% | 0 | 0 | 0 |
| | 90%~40% | −20 | −20 | −20 |
| | 40%~0% | −40 | −40 | −40 |

TABLE 9-continued

| | | DRUM FILM THK. (μm) | | |
|---|---|---|---|---|
| | | 25 μm | 20 μm | 15 μm |
| CYAN MOISTURE AMNT. 11.8 | | | | |
| DEVELOPING LIFE % | 100%~90% | 0 | 0 | 0 |
| | 90%~40% | −25 | −25 | −25 |
| | 40%~0% | −25 | −25 | −25 |
| CYAN MOISTURE AMNT. 21.5 | | | | |
| DEVELOPING LIFE % | 100%~90% | 0 | 0 | 0 |
| | 90%~40% | 0 | 0 | 0 |
| | 40%~0% | 0 | 0 | 0 |
| BLACK MOISTURE AMNT. 1.1 | | | | |
| DEVELOPING LIFE % | 100%~90% | 0 | 0 | 0 |
| | 90%~40% | −20 | −20 | −20 |
| | 40%~0% | −40 | −40 | −40 |
| BLACK MOISTURE AMNT. 11.8 | | | | |
| DEVELOPING LIFE % | 100%~90% | 0 | 0 | 0 |
| | 90%~40% | −15 | −15 | −15 |
| | 40%~0% | −15 | −15 | −15 |
| BLACK MOISTURE AMNT. 21.5 | | | | |
| DEVELOPING LIFE % | 100%~90% | 0 | 0 | 0 |
| | 90%~40% | 0 | 0 | 0 |
| | 40%~0% | 0 | 0 | 0 |
| CYAN MOISTURE AMNT. 1.1 | | | | |
| DEVELOPING LIFE % | 100%~90% | 0 | 0 | 0 |
| | 90%~40% | −20 | −20 | −20 |
| | 40%~0% | −40 | −40 | −40 |
| CYAN MOISTURE AMNT. 11.8 | | | | |
| DEVELOPING LIFE % | 100%~90% | 0 | 0 | 0 |
| | 90%~40% | −25 | −25 | −25 |
| | 40%~0% | −25 | −25 | −25 |
| CYAN MOISTURE AMNT. 21.5 | | | | |
| DEVELOPING LIFE % | 100%~90% | 0 | 0 | 0 |
| | 90%~40% | 0 | 0 | 0 |
| | 40%~0% | 0 | 0 | 0 |
| BLACK MOISTURE AMNT. 1.1 | | | | |
| DEVELOPING LIFE % | 100%~90% | 0 | 0 | 0 |
| | 90%~40% | −20 | −20 | −20 |
| | 40%~0% | −40 | −40 | −40 |
| BLACK MOISTURE AMNT. 11.8 | | | | |
| DEVELOPING LIFE % | 100%~90% | 0 | 0 | 0 |
| | 90%~40% | −15 | −15 | −15 |
| | 40%~0% | −15 | −15 | −15 |
| BLACK MOISTURE AMNT. 21.5 | | | | |
| DEVELOPING LIFE % | 100%~90% | 0 | 0 | 0 |
| | 90%~40% | 0 | 0 | 0 |
| | 40%~0% | 0 | 0 | 0 |

Table 9 represents a correction table as first correction information that is held in the drum memory 150 of the drum cartridge according to the third embodiment. Table 10 represents correction tables when combination 1-1 is used as an identification of cartridges described in Table 4 and indicates correction amounts which predict staining of the charging roller from toner and environmental information.

While the correction tables for the combination 1-1 of drum cartridges are shown in Table 10, correction tables corresponding to the combination tables 1-2, 1-3, and 1-4 separately exist and are held in the drum memory 150 together with combination information at the time of production.

S308, S309

In S309, use information of the developing cartridge 204 is confirmed and a second correction value θy of the charging bias based on the temperature and humidity and the use status (the developing life) of the developing cartridge 204 which are held in the developing memory 151 of the developing cartridge 204 is calculated from the correction table described in Table 10.

A tendency of durability deterioration of toner differs depending on a combination of the developing roller 17, the developing blade, and the like which are used. An effect of such factors is held as a correction value. In the present third embodiment, held values in Table 10 are all set to 0. In other words, correction of a charging bias in accordance with specific information of the developing cartridge is not performed. This is because an effect of variability in assembly at the time of production of the developing cartridge 204 is small.

TABLE 10

| | | DEVELOPING LIFE % | | |
|---|---|---|---|---|
| | | 100~70 | 70~30 | 30~0 |
| YELLOW | | | | |
| ENVR. MOISTURE CONTENT | 11.8 | 0 | 0 | 0 |
| | 1.1 | 0 | 0 | 0 |
| | 21.5 | 0 | 0 | 0 |
| MAGENTA | | | | |
| ENVR. MOISTURE CONTENT | 11.8 | 0 | 0 | 0 |
| | 1.1 | 0 | 0 | 0 |
| | 21.5 | 0 | 0 | 0 |
| CYAN | | | | |
| ENVR. MOISTURE CONTENT | 11.8 | 0 | 0 | 0 |
| | 1.1 | 0 | 0 | 0 |
| | 21.5 | 0 | 0 | 0 |
| BLACK | | | | |
| ENVR. MOISTURE CONTENT | 11.8 | 0 | 0 | 0 |
| | 1.1 | 0 | 0 | 0 |
| | 21.5 | 0 | 0 | 0 |

In the present third embodiment, the correction tables of Table 10 corresponding to a color of the toner used by the developing cartridge 204 are held in the developing memory 151. For example, in the case of the yellow developing cartridge, the yellow table is held, and in the case of the magenta developing cartridge, the magenta table is held. This is made possible by associating the color of the toner to be used with the developing memory 151 during assembly and production of the developing cartridge.

Performing this association during production in this manner eliminates the need to hold unnecessary information in the developing memory 151 and enables storage capacity of the developing memory 151 to be reduced.

In addition, when the association during production described above is not performed, having the developing memory 151 hold all of the correction tables shown in Table 10 enables control to be performed regardless of the color of the developing cartridge into which the developing memory 151 is assembled.

S310, S315

In S310, using the reference charging bias αy calculated in S303, the first correction value (ηy) calculated in S307, and the second correction value θy calculated in S309, an applied charging bias (Vpy) to be actually applied is calculated according to the following calculation formula.

Calculation formula $$\text{Applied charging bias } Vpy=\alpha y+\eta y+\theta y \quad (4)$$

Next, the flow advances to S315 and a bias is applied to the charging roller 2 by the control unit 220 based on the applied charging bias Vpy calculated by the main body controller 201.

By performing the control described above, the potential of the photosensitive drum can be kept constant over a long period of time.

In Case of 3B (Only the drum memory of the drum cartridge is recognized (mounted).)

In this case, the flow proceeds in a sequence of S306, S307, S308, S311, and S315.

In other words, the flow is the same as in the case of 3A up to S306 and S307 and the first correction value ηy is calculated, but since information of the developing memory 151 of the developing cartridge 204 is not obtained in S308, the flow advances to S311.

Since information in the developing memory of the developing cartridge cannot be obtained, θy becomes indeterminate in the calculation formula (4) described above. In addition, even with respect to ηy, since there is no use information of the developing cartridge, tables cannot be referred to. In this case, control is performed with an initial value of the developing life. Therefore, in the case of 3B where only the memory tag of the drum unit is recognized, the applied charging bias to be applied is determined by the following calculation formula (5).

$$\text{Applied charging bias } V'py=\alpha y+\eta' y \quad (5)$$

Since held values in Table 10 are all set to 0 in the present third embodiment, this amounts to V'py=αy.

Next, in S315, the control unit 220 performs control so as to apply the applied charging bias V'βy calculated in S311 to the charging roller 2.

In Case of 3C (Only the developing memory of the developing cartridge is recognized (mounted).)

In this case, the flow proceeds in a sequence of S306, S312, S313, and S315.

In other words, since information of the drum memory 150 is not obtained in S306, the flow advances to S312 to recognize the developing memory. Once the developing memory is recognized, the flow advances to S313.

Since information of the drum memory 150 has not been obtained, the first correction value ηy is indeterminate in the calculation formula (4) described above. In addition, since the film thickness information (the life information) of the photosensitive drum is absent, Table 10 cannot be referred to. In this case, control is performed with an initial value of the life of the photosensitive drum and the applied charging bias to be applied is determined by the following calculation formula (6).

$$\text{Applied charging bias } V'py=\alpha y+\theta y \quad (6)$$

Next, in S315, the control unit 220 performs control so as to apply the applied charging bias V'βy calculated in S313 to the charging roller 2.

In Case of 3D (Neither the drum memory of the drum cartridge nor the developing memory of the developing cartridge are recognized (mounted).)

In this case, both the step of recognition of the drum memory (S306) and the step of recognition of the developing memory (S312) result in (absent) and the flow advances to S314.

Since neither the drum memory 150 nor the developing memory 151 can be recognized, all of αy, ηy, and θy in the calculation formula (4) become indeterminate.

Therefore, in S314, $$\text{Applied charging bias } V'py=\text{indeterminate} \quad \text{Calculation formula}$$

is determined.

In this case, the applied charging bias V'py is controlled at a bias described in Table 16 set to the main body controller 201 in advance in a similar manner to the first embodiment.

In other words, in S315, the control unit 220 performs control so as to apply the applied charging bias V'βy calculated in S314 to the charging roller 2.

Fourth Embodiment

A feature of charge correction control according to the present fourth embodiment is that Table 11 is used as an offset table of the developing cartridge in S307 described in the third embodiment.

Specifically, Table 11 represents correction values of the charging bias in accordance with specific information of the developing cartridge and takes into consideration the fact that a tendency of durability deterioration of toner differs depending on a combination of the developing roller, the developing blade, and the like which are used. As described earlier, although there are a plurality of factors that affect the charging of toner, in the present embodiment, contact pressure of the developing blade and surface roughness of the developing roller are dominant. Therefore, as toner staining factors of the charging roller, a range of contact pressure of the developing blade and a range of surface roughness of the developing roller are respectively divided into two levels and respective correction amounts are held in a memory tag. The table shown in Table 11 represents combinations of key developing components which are held in the memory tag of the developing cartridge. The developing memory tag holds tables of the combinations 3-1 to 3-4 shown below and each table has a specific correction value.

TABLE 11

| | COMBINATION NAME | | | |
|---|---|---|---|---|
| | 3-1 | 3-2 | 3-3 | 3-4 |
| DEVELOPING ROLLER SURFACE ROUGHNESS RANGE | C | C | D | D |
| DEVELOPING BLADE PRESSURE RANGE | C | D | C | D |

Details of Table 11 are as Follows.

Developing roller surface roughness range C: surface roughness standard 8 to 19 (μm)

Developing roller surface roughness range D: surface roughness standard 19 to 30 (μm)

A developer roller used in the present fourth embodiment is the developing roller 17 used together with a negatively-charged developer and has a conductive shaft core, an elastic layer, and a conductive urethane resin layer that is a superficial layer.

Shaft Core

The shaft core has a columnar shape or a hollow cylindrical shape and is constituted by a conductive material such as the following. A metal or an alloy such as aluminum, a copper alloy, or stainless steel; iron subjected to a plating treatment using chromium or nickel; or a conductive synthetic resin. An appropriate known adhesive may be applied to a surface of the shaft core for the purpose of improving adhesion with the elastic layer to be provided on an outer circumferential surface of the shaft core.

Elastic Layer

The elastic layer contains an elastic material such as a resin or a rubber. Specific examples of the resin and rubber include the following. Polyamide, nylon, polyurethane resin, urea resin, polyimide, melamine resin, fluorine resin, phenolic resin, alkyd resin, polyester, polyether, acrylic resin, and mixtures thereof. Ethylene-propylene-diene copolymer rubber (EPDM), acrylonitrile-butadiene rubber (NBR), chloroprene rubber (CR), natural rubber (NR), isoprene rubber (IR), styrene-butadiene rubber (SBR), fluoronibber, silicone rubber, epichlorohydrin rubber, and hydrides of NBR. Among these materials, polyurethane resin is favorable since polyurethane resin has superior triboelectric charging performance to toner and flexibility which create more contact opportunities with toner and since polyurethane resin has wear resistance. In addition, even when the elastic layer is given a laminated structure constituted by two or more layers, polyurethane resin is favorably used as an outermost elastic layer. Examples of polyurethane resin include ether-based polyurethane resin, ester-based polyurethane resin, acrylic-based polyurethane resin, fluorine-based polyurethane resin, carbonate-based polyurethane resin, and olefin-based polyurethane resin.

Polyurethane resin can be obtained from polyol and isocyanate and a chain extender can be used when necessary. Examples of polyol as a raw material of polyurethane resin include polyether polyol, polyester polyol, polycarbonate polyol, polyolefin polyol, acrylic polyol, and mixtures thereof. Examples of isocyanate as a raw material of polyurethane resin include the following. Tolylene diisocyanate (TDI), diphenylmethane diisocyanate (MIDI), naphthalene diisocyanate (NDI), tolidine diisocyanate (TODI), hexamethylene diisocyanate isophorone diisocyanate (IPDI), phenylene diisocyanate (PPDI), xylylene diisocyanate (XDI), tetramethyl xylilene diisocyanate (TMXDI), cyclohexane diisocyanate, and mixtures thereof. Examples of a chain extender as a raw material of polyurethane resin include bifunctional low-molecular diols such as ethylene glycol, 1,4-butanediol, and 3-methyl pentanediol, trifunctional low-molecular triols such as trimethylolpropane, and mixtures thereof.

In addition, when the elastic layer is given a laminated structure constituted by two or more layers, silicone rubber is favorable as a material constituting an elastic layer (an underlayer) on the shaft core. Examples of silicone rubber include polydimethylsiloxane, polymethyl trifluoro propylsiloxane, polymethylvinylsiloxane, polyphenylvinylsiloxane, and copolymers of these siloxanes. One of these resins and rubbers may be used independently or two or more of these resins and rubbers may be used in combination. A material of resin and rubber can be identified by measuring the resin and rubber using a Fourier transform infrared spectrophotometer.

In addition, the elastic layer may further contain, when necessary, various additives such as particles, a conductive agent, a plasticizer, a filler, an extender, a vulcanizing agent, a vulcanization auxiliary, a crosslinking aid, a hardening inhibitor, an antioxidant, an anti-aging agent, and a processing aid. These arbitrary components can be contained in an amount which does not inhibit the functionality of the elastic layer.

Having the elastic layer contain particles enables a protruded portion to be formed on a surface of an electrophotographic member. The particles that may be added to the elastic layer favorably have a volume average particle size of at least 1 μm and not more than 30 μm. A particle size can be measured by observing a sectional surface by a scanning electron microscope (trade name: JSM-7800FPRIME Schottky field-emission scanning electron microscope, manufactured by JEOL Ltd.).

An amount of the particles to be contained in the elastic layer is favorably at least 1 part by mass and not more than 100 parts by mass of the particles relative to 100 parts by mass of the elastic material such as resin or rubber. As the particles, fine particles made of a resin such as polyurethane resin, polyester, polyether, polyamide, acrylic resin, or polycarbonate can be used. Among these resins, polyurethane resin particles are favorable due to their flexibility and wear resistance.

The elastic layer can be a conductive elastic layer created by blending a conductivity imparting agent such as an electronic conductive material or an ionic conductive material to the elastic material described above. Examples of an electronic conductive material include the following materials. Conductive carbons including ketjen black EC and carbon black such as acetylene black; carbons for rubber such as SAF (Super Abrasion Furnace), ISAF (Intermediate SAF), HAF (High Abrasion Furnace), FEF (Fast Extruding Furnace), GPF (General Purpose Furnace), SRF (Semi-Reinforcing Furnace), FT (Fine Thermal), and MT (Medium Thermal); carbons for color (ink) subjected to an oxidation treatment; and metals such as copper, silver, and germanium and metallic oxides thereof. Among these materials, conductive carbon is favorable since conductivity is readily controlled even in small amounts. Examples of an ionic conductive material include the following materials. Inorganic ionic conductive materials such as sodium perchlorate, lithium perchlorate, calcium perchlorate, and lithium chloride; and organic ionic conductive materials such as modified aliphatic dimethylammonium ethosulfate and stearyl ammonium acetate.

Examples of a filler include silica, quartz powder, and calcium carbonate.

Mixing of the respective materials for the elastic layer can be performed using a dynamic mixing apparatus such as a single shaft continuous kneader, a twin shaft continuous kneader, a two spindle roller, a kneader mixer, and TRI-MIX or a static mixing apparatus such as a static mixer.

Examples of a method of forming the elastic layer on the shaft core include a die molding method, an extrusion molding method, an injection molding method, and a coating molding method. A method of forming a first region to constitute a protruded portion will be described later. In the die molding method, for example, first, mold pieces for holding the shaft core inside a cylindrical mold are fixed to both ends of the mold and an injection port is formed in the mold pieces. Next, the shaft core is arranged inside the mold, and after injecting the materials for the elastic layer through the injection port, the mold can be heated at a temperature at which the materials harden and demolding can be performed. In the extrusion molding method, for example, both the shaft core and the materials for the elastic layer can be extruded using a crosshead extruder and the materials can be hardened to form the elastic layer around the shaft core.

When the elastic layer is given a laminated structure constituted by two or more layers, in order to improve adhesiveness, the surface of the elastic layer (the underlayer) on the side of the shaft core may be polished or modified by a surface modification method using a corona treatment, a flame treatment, or an excimer treatment.

In the present embodiment, a proper value of a toner coating amount on the developing roller 17 was obtained when the surface roughness of the developing roller 17 was set to Rz=8 to 30 (μm) in terms of ten-point average roughness (JIS (Japanese Industrial Standards)). In consideration thereof, the correction value of charging was set to two levels in accordance with the surface roughness of the developing roller 17. The levels are not limited to two levels and may be appropriately changed in accordance with a storage capacity of the memory tag and developing characteristics.

Developing blade pressure range C: developing blade pressure 10 to 20 (kgf/cm)

Developing blade pressure range D: developing blade pressure 20 to 40 (kgf/cm)

Configuration of Developing Blade

In the present embodiment, a leaf spring-like SUS thin plate with a free length in a transverse direction of 8 mm and a thickness of 0.08 mm is used as the developing blade 21. The developing blade is not limited thereto and a metal thin plate made of phosphor bronze, aluminum, or the like may be used.

Prescribed voltage is applied to the developing blade 21 from a blade bias power supply (not illustrated) to stabilize a toner coat, and V=−500 V is applied as a blade bias.

Figure 4B:
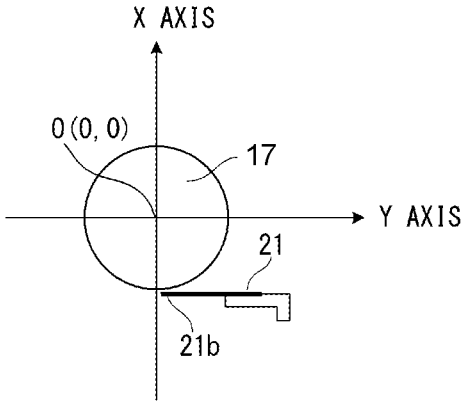
FIG. 4B is a schematic view of a developing blade.

A method of changing pressure contact pressure N (gf/mm) of the developing blade 21 relative to the developing roller 17 will now be described with reference to the schematic view in FIG. 4B. The schematic view is an explanatory diagram of a positional relationship between the developing blade 21 and the developing roller 17.

As shown in the schematic view, a coordinate system on a cross section that is perpendicular to a rotational axis of the developing roller 17 will be considered. Specifically, in the cross direction described above, a direction that is approximately parallel to a direction in which the developing blade 21 extends in a state where the developing blade 21 is pressed against the developing roller 17 is assumed to be a y axis and a direction perpendicular to the y axis is assumed to be an x axis. In addition, a rotational center O of the developing roller 17 is adopted as an origin of the coordinate system, and a center coordinate of the developing roller 17 is (x, y)=(0, 0). In this coordinate system, a position of a developing blade tip 21*b* in the x axis direction is assumed to be an X value and a position thereof in the y axis direction is assumed to be a Y value. The pressure contact pressure (gf/mm) was changed by changing the X value and the Y value described above.

Method of Measuring Pressure Contact Pressure

When measuring pressure contact pressure N (gf/mm) of the developing blade 21 relative to the developing roller 17, the developing apparatus from which the developing roller 17 has been detached was mounted to a dedicated measurement jig. In addition, an aluminum sleeve with the same diameter as the developing roller 17 was prepared as a virtual developing roller and a measurement was taken by bringing the developing blade 21 into contact with the aluminum sleeve.

Using a probe with a longitudinal length of 50 mm, contact pressure of the toner supplying roller 20 is calculated from an average value of two measurement points at both ends and three central measurement points.

A relationship between the pressure contact pressure N (gf/mm) of the developing blade with respect to the developing roller and the X value and Y value of the developing blade tip 21*b* according to the present embodiment is shown below in Table 12.

TABLE 12

| X VALUE (mm) | Y VALUE (mm) | PRESSURE CONTACT PRESSURE N (gf/mm) |
|---|---|---|
| −5.55 | 1.0 | 1.2 |
| −5.45 | 1.0 | 1.5 |
| −5.40 | 1.0 | 1.7 |
| −5.30 | 1.0 | 2 |
| −5.00 | 1.0 | 3 |
| −4.70 | 1.0 | 4 |
| −4.55 | 1.0 | 4.5 |
| −4.45 | 1.0 | 4.8 |

In the present embodiment, setting the pressure contact pressure N (gf/mm) of the developing blade relative to the developing roller between 2.0 (gf/mm) and 4.0 (gf/mm) enabled the toner used to be charged with a desired charge.

In this manner, by setting the surface roughness of the developing roller 17 and the contact pressure of the developing blade 21 within ranges which enable toner to be imparted with a desired charge, the problem of fogging in which toner is inadvertently developed on a solid white background can be suppressed. As a result, since toner recovered by the cleaning blade 6 of the drum cartridge 213 is reduced, staining of the charging roller 2 can be suppressed.

Therefore, with the two-body cartridge that is a feature of the present invention and, particularly, even when the life of the drum cartridge 213 is longer than the life of the developing cartridge 204, stable charge control can be performed.

In the present fourth embodiment, correction amounts based on toner deterioration factors that occur due to differences in the surface roughness of the developing roller 17 and the blade pressure of the developing blade 21 are provided. The present invention is not limited thereto and a correction table based on other parameters may also be preferably used.

Examples of the other parameters include hardness, deflection, and resistance of the developing roller 17, surface roughness, environmental characteristics of materials, and environmental characteristics of hardness of the developing blade 21, and the like.

Table 13 shows a correction table held in the developing memory 151 of the developing cartridge 204 according to the fourth embodiment.

The correction table holds correction values in accordance with developing life and each environment, for each combination of the developing roller 17 and the developing blade 21 of the developing cartridge 204, and in accordance with each toner color.

In the present fourth embodiment, a correction table for each color of the toners used by the developing cartridge 204 and each combination of the developing roller 17 and the developing blade 21 used in the developing cartridge 204 are held in the developing memory 151.

TABLE 13

| | | DEVELOPING LIFE % | | |
|---|---|---|---|---|
| | | 100~70 | 70~30 | 30~0 |
| COMBINATION 3-1 YELLOW | | | | |
| ENVR. | 11.8 | 0 | 0 | 0 |
| MOISTURE | 1.1 | 0 | −5 | −10 |
| CONTENT | 21.5 | 0 | 0 | 0 |

TABLE 13-continued

| | | DEVELOPING LIFE % | | |
|---|---|---|---|---|
| | | 100~70 | 70~30 | 30~0 |
| | | MAGENTA | | |
| ENVR. | 11.8 | 0 | 0 | 0 |
| MOISTURE | 1.1 | 0 | −15 | −20 |
| CONTENT | 21.5 | 0 | 0 | 0 |
| | | CYAN | | |
| ENVR. | 11.8 | 0 | 0 | 0 |
| MOISTURE | 1.1 | 0 | −15 | −20 |
| CONTENT | 21.5 | 0 | 0 | 0 |
| | | BLACK | | |
| ENVR. | 11.8 | 0 | 0 | 0 |
| MOISTURE | 1.1 | 0 | −10 | −15 |
| CONTENT | 21.5 | 0 | 0 | 0 |
| | | COMBINATION 3-2 YELLOW | | |
| ENVR. | 11.8 | 0 | 0 | 0 |
| MOISTURE | 1.1 | 0 | 0 | 0 |
| CONTENT | 21.5 | 0 | 0 | 0 |
| | | MAGENTA | | |
| ENVR. | 11.8 | 0 | 0 | 0 |
| MOISTURE | 1.1 | 0 | −5 | −10 |
| CONTENT | 21.5 | 0 | 0 | 0 |
| | | CYAN | | |
| ENVR. | 11.8 | 0 | 0 | 0 |
| MOISTURE | 1.1 | 0 | −10 | −15 |
| CONTENT | 21.5 | 0 | 0 | 0 |
| | | BLACK | | |
| ENVR. | 11.8 | 0 | 0 | 0 |
| MOISTURE | 1.1 | 0 | −5 | −10 |
| CONTENT | 21.5 | 0 | 0 | 0 |
| | | COMBINATION 3-3 YELLOW | | |
| ENVR. | 11.8 | 0 | 0 | 0 |
| MOISTURE | 1.1 | 0 | 0 | 0 |
| CONTENT | 21.5 | 0 | 0 | 0 |
| | | MAGENTA | | |
| ENVR. | 11.8 | 0 | 0 | 0 |
| MOISTIRE | 1.1 | 0 | 0 | 0 |
| CONTENT | 21.5 | 0 | 0 | 0 |
| | | CYAN | | |
| ENVR. | 11.8 | 0 | 0 | 0 |
| MOISTURE | 1.1 | 0 | 0 | 0 |
| CONTENT | 21.5 | 0 | 0 | 0 |
| | | BLACK | | |
| ENVR. | 11.8 | 0 | 0 | 0 |
| MOISTURE | 1.1 | 0 | 0 | 0 |
| CONTENT | 21.5 | 0 | 0 | 0 |
| | | COMBINATION 3-4 YELLOW | | |
| ENVR. | 11.8 | 0 | 0 | 0 |
| MOISTURE | 1.1 | 0 | 0 | 0 |
| CONTENT | 21.5 | 0 | 0 | 0 |
| | | MAGENTA | | |
| ENVR. | 11.8 | 0 | 0 | 0 |
| MOISTURE | 1.1 | 0 | 0 | −5 |
| CONTENT | 21.5 | 0 | 0 | 0 |
| | | CYAN | | |
| ENVR. | 11.8 | 0 | 0 | 0 |
| MOISTURE | 1.1 | 0 | −5 | −10 |
| CONTENT | 21.5 | 0 | 0 | 0 |
| | | BLACK | | |
| ENVR. | 11.8 | 0 | 0 | 0 |
| MOISTURE | 1.1 | 0 | 0 | 0 |
| CONTENT | 21.5 | 0 | 0 | 0 |

For example, with the yellow developing cartridge 204, when the surface roughness of the developing roller 17 at the time of production is 8 to 19 μm and the developing blade pressure is 15 to 25, the yellow table of combination 3-1 in Table 11 is held. In a similar manner, with the magenta developing cartridge 204, when the surface roughness of the developing roller 17 is 19 to 30 μm and the developing blade pressure is 25 to 40, the magenta correction table of combination 3-4 in Table 11 is held in the developing memory 151.

This is made possible by associating the color of the toner to be used, roughness information of the developing roller, and pressure information of the developing blade with the developing memory 151 during assembly and production of the developing cartridge 204. Performing this association during production in this manner eliminates the need to hold unnecessary information in the developing memory 151 and enables the capacity of the developing memory 151 to be reduced.

In addition, when the association during production is not performed, having the developing memory 151 hold all of the correction tables shown in Table 13 enables control to be performed regardless of the color of the developing cartridge into which the developing memory 151 is assembled.

By performing the control described above, since correction control that takes production variability of the developing cartridge 204 into consideration is performed, the potential of the photosensitive drum 1 can be kept constant over a long period of time.

Even in the present third and fourth embodiments, when at least one of the drum memory and the developing memory cannot be recognized or when holding forms of the memories differ, the following control is performed.

The present control enables an image forming operation to be performed with an image forming apparatus. However, the control is insufficient for the purpose of charging potential stabilization and an appropriate dark-part potential cannot be obtained throughout the service life. Therefore, a state needs to be created where memory tags of both the drum cartridge and the developing cartridge can be recognized.

Next, the following verification test 2 was performed in order to verify effects of the present third and fourth embodiments.

Verification Test 2

In a similar manner to verification test 1, a durability test involving intermittently passing paper was performed using cartridges having a memory tag holding correction information according to the present embodiment as the two-body cartridges to be used in the electrophotographic system image forming apparatus shown in FIG. 1, and the presence or absence of an occurrence of an abnormal image during the durability test was verified.

In a low temperature, low humidity environment (L/L: 15° C./10% RH), the image forming apparatus intermittently printed images on 30000 sheets of A4 paper (from developing life 100% to 0%) at a print percentage of 1%, and images were evaluated. An item of image defect refers to a so-called fogged image in which toner is developed on a solid white image. A measurement of a fogging amount was quantified by applying a transparent tape on the surface of the photosensitive drum and subsequently measuring the tape with a reflection densitometer (TC-6DS manufactured by Tokyo Denshoku CO., LTD.). In the present embodiment, since fogging in unacceptable image density occurred on paper when fogging on the photosensitive drum was 5% or higher, 5% or higher was determined to be unacceptable (indicated with "X") and lower than 5% was determined to be acceptable (indicated with "O").

Verification 2-1

Table 14 shows results of an occurrence of image defects for combinations of the developing cartridge and the drum cartridge and charge control during paper passing (third embodiment, fourth embodiment, and conventional controls 3B, 3C, 3D, 4B, 4C, and 4D). As the drum cartridges, the drum cartridges of combination 1-1 described in the first and second embodiments were used.

The results in Table 14 were obtained by using both the developing cartridge and the drum cartridge from brand-new states and passing paper until the developing cartridge reached a developing life of 0% and, with respect to the drum cartridge, the film thickness of the drum A decreased from 25 μm to 20 μm. % in the table indicates a developing life % at the time of occurrence of an abnormal image, and the sign "O" indicates that an abnormal image has not occurred.

It is shown that, in the controls according to the conventional modes, charging potential deviates and fogging occurs as the developing durability test processes. Specifically, this is mainly due to a difference in staining of the charging member and a difference in characteristics of the drum cartridge. With the present embodiments, since charging bias is controlled in consideration of the above, a stable drum potential can be obtained throughout the entire lives of the developing machine and the drum cartridge.

Verification 2-2

In a similar manner to verification 2-1, verification 2-2 verified results of an occurrence of image defects for combinations of the developing cartridge and the drum cartridge and charge control during paper passing (third embodiment ("EMBT.3"), fourth embodiment ("EMBT.4"), and control flows 3B, 3C, 3D, 4B, 4C, and 4D). In verification 2-2, a drum cartridge midway through its product life was used.

TABLE 14

| DEVELOPING CARTRIDGE | DRUM CARTRIDGE COMBINATION | RESULT(CORRECTION CONTROL/IMAGE DEFECT OCCURRENCE TIMING) | | | | | | | |
|---|---|---|---|---|---|---|---|---|---|
| Yellow | 3-1 | EMBT.3/O | EMBT.4/O | 3B/5% | 3C/8% | 3D/1% | 4B/7% | 4C/2% | 4D/3% |
| Yellow | 3-2 | EMBT.3/O | EMBT.4/O | 3B/8% | 3C/4% | 3D/7% | 4B/7% | 4C/7% | 4D/7% |
| Yellow | 3-3 | EMBT.3/O | EMBT.4/O | 3B/4% | 3C/1% | 3D/6% | 4B/5% | 4C/10% | 4D/11% |
| Yellow | 3-4 | EMBT.3/O | EMBT.4/O | 3B/6% | 3C/7% | 3D/8% | 4B/9% | 4C/8% | 4D/6% |
| Mgenta | 3-1 | EMBT.3/O | EMBT.4/O | 3B/11% | 3C/12% | 3D/5% | 4B/9% | 4C/12% | 4D/5% |
| Mgenta | 3-2 | EMBT.3/O | EMBT.4/O | 3B/10% | 3C/17% | 3D/15% | 4B/11% | 4C/6% | 4D/9% |
| Mgenta | 3-3 | EMBT.3/O | EMBT.4/O | 3B/12% | 3C/12% | 3D/22% | 4B/17% | 4C/20% | 4D/7% |
| Mgenta | 3-4 | EMBT.3/O | EMBT.4/O | 3B/18% | 3C/7% | 3D/6% | 4B/15% | 4C/14% | 4D/8% |
| Cyan | 3-1 | EMBT.3/O | EMBT.4/O | 3B/19% | 3C/22% | 3D/12% | 4B/17% | 4C/28% | 4D/9% |
| Cyan | 3-2 | EMBT.3/O | EMBT.4/O | 3B/27% | 3C/27% | 3D/25% | 4B/19% | 4C/22% | 4D/10% |
| Cyan | 3-3 | EMBT.3/O | EMBT.4/O | 3B/23% | 3C/32% | 3D/35% | 4B/31% | 4C/16% | 4D/15% |
| Cyan | 3-4 | EMBT.3/O | EMBT.4/O | 3B/35% | 3C/37% | 3D/24% | 4B/33% | 4C/29% | 4D/18% |
| Black | 3-1 | EMBT.3/O | EMBT.4/O | 3B/7% | 3C/6% | 3D/5% | 4B/2% | 4C/24% | 4D/7% |
| Black | 3-2 | EMBT.3/O | EMBT.4/O | 3B/2% | 3C/6% | 3D/7% | 4B/7% | 4C/8% | 4D/11% |
| Black | 3-3 | EMBT.3/O | EMBT.4/O | 3B/3% | 3C/2% | 3D/9% | 4B/9% | 4C/6% | 4D/15% |
| Black | 3-4 | EMBT.3/O | EMBT.4/O | 3B/3% | 3C/7% | 3D/5% | 4B/3% | 4C/6% | 4D/14% |

Result of Verification 2-1

Table 14 shows that, in the present embodiments, appropriate charging bias control can be performed without image defects. On the other hand, faulty charging has occurred in all of the conventional controls.

The results in Table 15 were obtained by using the developing cartridge from a brand-new state and passing paper until the developing cartridge reached a developing life of 0% and the film thickness of the drum cartridge A decreased from 20 μm to 15 μm.

TABLE 15

| DEVELOPING CARTRIDGE | DRUM CARTRIDGE COMBINATION | RESULT(CORRECTION CONTROL/IMAGE DEFECT OCCURRENCE TIMING) | | | | | | | |
|---|---|---|---|---|---|---|---|---|---|
| Yellow | 3-1 | EMBT.3/O | EMBT.4/O | 3B/55% | 3C/47% | 3D/55% | 4B/68% | 4C/59% | 4D/3% |
| Yellow | 3-2 | EMBT.3/O | EMBT.4/O | 3B/68% | 3C/35% | 3D/61% | 4B/67% | 4C/63% | 4D/66% |
| Yellow | 3-3 | EMBT.3/O | EMBT.4/O | 3B/64% | 3C/46% | 3D/56% | 4B/77% | 4C/50% | 4D/71% |
| Yellow | 3-4 | EMBT.3/O | EMBT.4/O | 3B/66% | 3C/49% | 3D/59% | 4B/71% | 4C/64% | 4D/39% |
| Mgenta | 3-1 | EMBT.3/O | EMBT.4/O | 3B/81% | 3C/62% | 3D/49% | 4B/69% | 4C/88% | 4D/46% |
| Mgenta | 3-2 | EMBT.3/O | EMBT.4/O | 3B/90% | 3C/71% | 3D/58% | 4B/79% | 4C/81% | 4D/75% |
| Mgenta | 3-3 | EMBT.3/O | EMBT.4/O | 3B/88% | 3C/73% | 3D/62% | 4B/76% | 4C/83% | 4D/39% |
| Mgenta | 3-4 | EMBT.3/O | EMBT.4/O | 3B/89% | 3C/70% | 3D/73% | 4B/78% | 4C/88% | 4D/79% |
| Cyan | 3-1 | EMBT.3/O | EMBT.4/O | 3B/91% | 3C/82% | 3D/77% | 4B/81% | 4C/78% | 4D/97% |
| Cyan | 3-2 | EMBT.3/O | EMBT.4/O | 3B/77% | 3C/87% | 3D/89% | 4B/88% | 4C/90% | 4D/91% |
| Cyan | 3-3 | EMBT.3/O | EMBT.4/O | 3B/83% | 3C/92% | 3D/85% | 4B/90% | 4C/91% | 4D/80% |
| Cyan | 3-4 | EMBT.3/O | EMBT.4/O | 3B/85% | 3C/87% | 3D/94% | 4B/91% | 4C/88% | 4D/68% |
| Black | 3-1 | EMBT.3/O | EMBT.4/O | 3B/77% | 3C/56% | 3D/65% | 4B/41% | 4C/57% | 4D/71% |
| Black | 3-2 | EMBT.3/O | EMBT.4/O | 3B/52% | 3C/66% | 3D/75% | 4B/38% | 4C/66% | 4D/41% |
| Black | 3-3 | EMBT.3/O | EMBT.4/O | 3B/83% | 3C/78% | 3D/47% | 4B/38% | 4C/36% | 4D/69% |
| Black | 3-4 | EMBT.3/O | EMBT.4/O | 3B/67% | 3C/69% | 3D/67% | 4B/48% | 4C/47% | 4D/54% |

Result of Verification 2-2

As shown in Table 15, in the present embodiments, appropriate charging bias control can be performed without image defects. On the other hand, faulty charging has occurred in all of the conventional controls.

Table 15 shows that, in an advanced state of durability deterioration of the photosensitive drum, a desired charging potential cannot be obtained even when a brand-new developing cartridge is used. When the durability test progresses in this state, a difference in potential is created even when the same toner is used in the durability test.

Even in this state, since charging bias is controlled in consideration of the above in the present third and fourth embodiments, a stable drum potential can be obtained throughout the entire life of the developing machine.

As described above, the embodiments of the present invention are capable of solving a problem in conventional art. Specifically, when charge control information is stored in a memory of an apparatus main body of an image forming apparatus to perform potential stabilizing control, in the event that specifications of a photosensitive drum, a charging roller, or the like is changed after the image forming apparatus becomes commercially available, since a memory tag of a cartridge is caused to store a change in control information for performing suitable charge control, potential control can be performed in an appropriate manner.

In addition, even when a photosensitive member memory and a developing memory are respectively arranged in a photosensitive member cartridge and a developing cartridge, a decline in charging ability due to staining of a charging roller which is specific to the photosensitive member cartridge can be suitably controlled based on the correction control held in the memory.

Furthermore, by causing a drum memory of a drum cartridge to store, for all colors, stain information of a charging roller of each used color, the drum cartridge can be used as a so-called universal drum cartridge which can be used in a flexible manner regardless of a station of the used image forming apparatus or regardless of the color of toner used by the developing cartridge that is paired with the drum cartridge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-010104, filed on Jan. 24, 2018 and Japanese Patent Application No. 2018-245218, filed on Dec. 27, 2018, which is hereby incorporated by reference herein in its entirety.

What is claimed is:

1. An image forming apparatus, comprising:

an apparatus main body;

an image bearing member unit having at least an image bearing member and a charging member; and a developing unit having at least a developer bearing member, wherein the image bearing member unit and a developing unit are independently attachable and detachable to the apparatus main body, the apparatus main body has a controller, the image bearing member unit further has a first storage unit that stores first correction information corresponding to life information of the developing unit, the developing unit further has a second storage unit that stores second correction information corresponding to life information of the image bearing member unit, and the controller acquires the first correction information stored in the first storage unit and the second correction information stored in the second storage unit, uses the acquired first correction information and the acquired second correction information to correct a charging bias to be applied to the charging member, and controls to apply the corrected charging bias to the charging member.

2. The image forming apparatus according to claim 1, wherein the controller further has a third storage unit that stores, in advance, reference information of a reference charging bias to be applied to the charging member, and the controller acquires the reference information from the third storage unit and uses the acquired first correction information and the acquired second correction information to correct the reference charging bias corresponding to the acquired reference information.

3. The image forming apparatus according to claim 2, wherein a plurality of types of the reference information of the charging bias, a plurality of types of the first correction information and a plurality of types of the second correction information are set in advance according to environmental information.

4. The image forming apparatus according to claim 3, wherein the apparatus main body further has a detecting unit that detects the environmental information, and the controller acquires the environmental information from the detecting unit, acquires the first correction information and the second correction information according to the acquired environmental information, uses the acquired first correction information and the acquired second correction information to correct the reference information of the charging bias.

5. The image forming apparatus according to claim 2, wherein a plurality of types of the reference information of the charging bias, a plurality of types of the first correction information and a plurality of types of the second correction information are set according to developer colors.

6. The image forming apparatus according to claim 5, wherein the apparatus main body further has a plurality of image forming portions, the plurality of image forming portions forming images with colors that differ from each other, and the color for the image bearing member unit is determined according to the color of the image formed by the image forming portion attached to the apparatus main body.

7. The image forming apparatus according to claim 1, wherein the first correction information stored in the first storage unit is correction information that is set in advance according to the life information of the image bearing member unit, and the second correction information stored in the second storage unit is correction information that is set in advance according to the life information of the developing unit and the life information of the image bearing member unit.

8. The image forming apparatus according to claim 7, wherein life of the image bearing member is longer than life of the developing unit, the developing unit is replaced midway through the life of the image bearing member, the second correction information is the life information of the image bearing member unit and correction information that is set in advance according to life information of each of a plurality of developing units to be replaced.

9. The image forming apparatus according to claim 8, wherein the first correction information corresponds to charging characteristics specific to the image bearing member unit.

10. The image forming apparatus according to claim 9, wherein the charging characteristics specific to the image bearing member unit corresponds to a combination of a type of the image bearing member and a type of the charging member.

11. The image forming apparatus according to claim 1, wherein the first correction information corresponds to charging characteristics specific to the image bearing member unit.

12. The image forming apparatus according to claim 11, wherein the charging characteristics specific to the image bearing member unit corresponds to a combination of a type of the image bearing member and a type of the charging member.

13. The image forming apparatus according to claim 1, wherein the first correction information stored in the first storage unit is correction information that is set in advance according to the life information of the image bearing member unit and the life information of the developing unit, and the second correction information stored in the second storage unit is correction information that is set in advance according to the life information of the developing unit.

14. The image forming apparatus according to claim 13, wherein life of the image bearing member is longer than life of the developing unit, the developing unit is replaced midway through the life of the image bearing member, the first correction information is the life information of the image bearing member unit and correction information that is set in advance according to life information of each of a plurality of developing units to be replaced.

15. The image forming apparatus according to claim 13, wherein the second correction information stored in the second storage unit corresponds to characteristics specific to the developing unit.

16. The image forming apparatus according to claim 15, wherein the developing unit further comprises a developer bearing member and a developer regulating member that contacts the developer bearing member by pressure to regulate a layer of developer, and the characteristics specific to the developing unit corresponds to a combination of a type of the developer bearing member and a type of the developer regulating member.

17. The image forming apparatus according to claim 1, wherein when the controller fails to acquire one of the first correction information and the second correction information and acquires the other thereof, the controller uses the other thereof to correct the charging bias.

18. The image forming apparatus according to claim 1, wherein a storage capacity of the first storage unit is equal to a storage capacity of the second storage unit.

* * * * *